US009428900B2

(12) United States Patent
Wroblewski et al.

(10) Patent No.: US 9,428,900 B2
(45) Date of Patent: Aug. 30, 2016

(54) ROUGH-IN ADAPTER

(71) Applicant: Zurn Industries, LLC, Erie, PA (US)

(72) Inventors: Douglas R. Wroblewski, Erie, PA (US); Christopher A. Majocka, Erie, PA (US); William A. Verdecchia, Erie, PA (US)

(73) Assignee: Zurn Industries, LLC, Milwaukee, WI (US)

( * ) Notice: Subject to any disclaimer, the term of this patent is extended or adjusted under 35 U.S.C. 154(b) by 239 days.

(21) Appl. No.: 14/067,036

(22) Filed: Oct. 30, 2013

(65) Prior Publication Data

US 2014/0116527 A1 May 1, 2014

Related U.S. Application Data

(60) Provisional application No. 61/720,447, filed on Oct. 31, 2012, provisional application No. 61/886,319, filed on Oct. 3, 2013.

(51) Int. Cl.
*E03F 5/04* (2006.01)

(52) U.S. Cl.
CPC ..... *E03F 5/0407* (2013.01); *E03F 2005/0413* (2013.01); *Y10T 137/0402* (2015.04); *Y10T 137/598* (2015.04); *Y10T 137/6988* (2015.04)

(58) Field of Classification Search
CPC . F16L 5/00; E03F 5/0407; E03F 2005/0413; A47K 3/00; Y10T 137/6988
USPC ..... 137/15.01, 15.09, 315.01, 362; 285/56–60; 4/679, 680
See application file for complete search history.

(56) References Cited

U.S. PATENT DOCUMENTS 872,331 A 12/1907 Dreier
969,776 A 9/1910 Foley
(Continued)

FOREIGN PATENT DOCUMENTS

DE 9102152 U1 5/1991
DE 19901555 A1 7/2000
(Continued)

OTHER PUBLICATIONS

Zurn Industries Hydromechanics Handbook 984, cover and pp. 18 and 121 (1984).
(Continued)

*Primary Examiner* — Kevin Murphy
*Assistant Examiner* — Jonathan Waddy
(74) *Attorney, Agent, or Firm* — Quarles & Brady LLP

(57) ABSTRACT

A drain assembly includes a drain body connected to a drain pipe such that the drain body is in fluid communication with the drain pipe; and a drain head assembly adjustably connected to the drain body such that the drain head assembly is in fluid communication with the drain body. The drain head assembly includes a shank adjustably connected to the drain body and a strainer assembly connected to the shank. The strainer assembly includes a strainer, an upper frame, and a lower frame connected to each other. The lower frame includes a connection feature that non-threadably and removably connects the strainer assembly to the shank. The drain assembly further includes a cover removably connected to the shank in a position over the shank and to at least partially define a void in a poured concrete slab around the shank.

15 Claims, 21 Drawing Sheets

(56) References Cited

U.S. PATENT DOCUMENTS

| | | | |
|---|---|---|---|
| 1,007,463 | A | 10/1911 | Madden |
| 1,375,222 | A | 4/1921 | Lutz |
| 1,434,254 | A | 10/1922 | Sanders |
| 1,577,464 | A | 3/1926 | High |
| 1,584,986 | A | 5/1926 | Fleming |
| 1,608,115 | A | 11/1926 | Neidecken |
| 1,648,701 | A | 11/1927 | Smallbrook |
| 1,653,403 | A | 12/1927 | McCue |
| 1,669,586 | A | 5/1928 | Boosey |
| 1,731,617 | A | 10/1929 | Fleming |
| 1,739,067 | A | 12/1929 | Fleming |
| 1,766,621 | A | 6/1930 | Fleming |
| 1,786,558 | A | 12/1930 | Boosey |
| 1,792,345 | A | 2/1931 | Williams |
| 1,805,816 | A | 5/1931 | Fleming |
| 1,812,583 | A | 6/1931 | Cavalieri |
| 1,828,601 | A | 10/1931 | Frye |
| 1,830,065 | A | 11/1931 | Luff |
| 1,873,275 | A | 8/1932 | Boosey |
| 1,993,534 | A | 3/1935 | Stoltz |
| 2,003,770 | A | 6/1935 | Goodhart |
| 2,019,779 | A | 11/1935 | Fleming |
| 2,095,024 | A | 10/1937 | Boosey |
| 2,143,499 | A | 1/1939 | Siegmann |
| 2,190,532 | A | 2/1940 | Lukomski |
| 2,278,566 | A | 4/1942 | Schaible |
| 2,299,705 | A | 10/1942 | Svirsky |
| 2,324,545 | A | 7/1943 | Svirsky |
| 2,394,964 | A | 2/1946 | Dick |
| 2,400,070 | A | 5/1946 | Boosey |
| 2,471,301 | A | 5/1949 | Boosey |
| 2,490,075 | A | 12/1949 | Matheis |
| 2,501,971 | A | 3/1950 | Schenck |
| 2,519,843 | A | 8/1950 | Matheis |
| 2,550,402 | A | 4/1951 | Boosey |
| 2,626,674 | A | 1/1953 | Boosey |
| 2,629,457 | A | 2/1953 | Baker |
| 2,684,518 | A | 7/1954 | Whitlock |
| 2,743,786 | A | 5/1956 | Boosey |
| 2,749,999 | A | 6/1956 | Schmid |
| 2,783,852 | A | 3/1957 | Sisk |
| 2,889,928 | A | 6/1959 | Sisk |
| 2,948,399 | A | 8/1960 | Sisk |
| 3,071,781 | A | 1/1963 | Seewack |
| 3,173,443 | A | 3/1965 | Saville |
| 3,212,416 | A | 10/1965 | Boersma |
| 3,255,912 | A | 6/1966 | Schmid |
| 3,265,349 | A | 8/1966 | Hamrick |
| 3,276,176 | A | 10/1966 | Jonsson et al. |
| 3,285,289 | A | 11/1966 | Titus |
| 3,362,425 | A | 1/1968 | Morris et al. |
| 3,378,858 | A | 4/1968 | Jacuzzi |
| 3,412,759 | A | 11/1968 | Potter et al. |
| 3,445,973 | A | 5/1969 | Stone |
| 3,495,280 | A | 2/1970 | Galbiati |
| 3,668,718 | A | 6/1972 | Cuschera |
| 3,674,149 | A | 7/1972 | Donalson |
| 3,703,302 | A | 11/1972 | Demler, Sr. |
| 3,800,486 | A | 4/1974 | Harvey |
| 3,921,661 | A | 11/1975 | Emberson |
| 3,964,219 | A | 6/1976 | Hala |
| 4,017,051 | A | 4/1977 | Scott et al. |
| 4,067,072 | A | 1/1978 | Izzi |
| 4,092,745 | A | 6/1978 | Oropallo |
| 4,146,939 | A | 4/1979 | Izzi |
| 4,161,043 | A | 7/1979 | Flores |
| 4,207,632 | A | 6/1980 | Savell, Jr. et al. |
| 4,212,486 | A | 7/1980 | Logsdon |
| 4,233,697 | A | 11/1980 | Cornwall |
| 4,257,892 | A | 3/1981 | Boersma |
| 4,261,824 | A | 4/1981 | Cuschera |
| 4,325,405 | A | 4/1982 | Christo |
| 4,427,619 | A | 1/1984 | Peterson |
| RE31,561 | E | 4/1984 | Thompson |
| 4,454,039 | A | 6/1984 | McCoy |
| 4,475,844 | A | 10/1984 | Arntyr et al. |
| 4,614,065 | A | 9/1986 | Papp |
| 4,620,330 | A | 11/1986 | Izzi, Sr. |
| 4,621,939 | A | 11/1986 | Thomann et al. |
| 4,622,703 | A | 11/1986 | Cuschera |
| 4,655,913 | A | 4/1987 | Boersma |
| 4,678,097 | A | 7/1987 | Crute |
| 4,694,513 | A | 9/1987 | Kiziah |
| 4,730,854 | A | 3/1988 | Cuschera |
| 4,815,888 | A | 3/1989 | Stegmeier |
| 4,823,411 | A | 4/1989 | Nettel |
| 4,823,527 | A | 4/1989 | Harbeke |
| 4,842,240 | A | 6/1989 | Pickett |
| 4,842,443 | A | 6/1989 | Argandona |
| 4,850,617 | A | 7/1989 | Moberly |
| 4,871,451 | A | 10/1989 | Piskula |
| 4,879,771 | A | 11/1989 | Piskula |
| 4,883,590 | A | 11/1989 | Papp |
| 4,909,660 | A | 3/1990 | Ferns |
| 4,910,811 | A | 3/1990 | Izzi, Sr. |
| 4,952,094 | A | 8/1990 | Spiess et al. |
| RE33,439 | E | 11/1990 | Thomann et al. |
| 4,967,422 | A | 11/1990 | Novak |
| 4,984,309 | A | 1/1991 | Lowry |
| 5,115,554 | A | 5/1992 | Fell, Sr. |
| 5,121,509 | A | 6/1992 | Juple |
| 5,124,031 | A | 6/1992 | Dallmer |
| 5,145,276 | A | 9/1992 | Demange |
| 5,211,685 | A | 5/1993 | Garcia |
| 5,324,135 | A | 6/1994 | Smith |
| 5,328,291 | A | 7/1994 | Wisniewski |
| 5,377,361 | A | 1/1995 | Piskula |
| 5,437,516 | A | 8/1995 | Sauerwein et al. |
| 5,490,365 | A | 2/1996 | Roth |
| 5,503,181 | A | 4/1996 | Kennedy |
| 5,527,131 | A | 6/1996 | Salmond et al. |
| 5,538,154 | A | 7/1996 | Von Holdt |
| 5,564,860 | A | 10/1996 | Amann |
| 5,623,971 | A | 4/1997 | Foernzler |
| 5,624,123 | A | 4/1997 | Meyers |
| 5,692,248 | A * | 12/1997 | Ball ..... 4/286 |
| 5,704,659 | A | 1/1998 | Lunder |
| 5,722,554 | A | 3/1998 | Chanal et al. |
| 5,733,444 | A | 3/1998 | Johnson |
| 5,878,448 | A | 3/1999 | Molter |
| 5,921,282 | A | 7/1999 | Castillo et al. |
| 5,938,055 | A | 8/1999 | Philips et al. |
| 5,960,819 | A | 10/1999 | Weissinger et al. |
| 5,975,116 | A | 11/1999 | Rosas et al. |
| 5,996,134 | A | 12/1999 | Senninger |
| 6,016,846 | A | 1/2000 | Knittel et al. |
| 6,036,401 | A | 3/2000 | Morina et al. |
| 6,058,525 | A | 5/2000 | Paden |
| 6,061,983 | A | 5/2000 | McCleskey |
| 6,076,559 | A | 6/2000 | Castillo et al. |
| 6,085,362 | A | 7/2000 | Huber |
| 6,088,972 | A | 7/2000 | Johanneck |
| 6,092,244 | A | 7/2000 | Rizzardi et al. |
| 6,101,774 | A | 8/2000 | Heil |
| 6,152,494 | A | 11/2000 | Corbett, Sr. et al. |
| 6,161,873 | A | 12/2000 | Munzenberger et al. |
| 6,165,357 | A | 12/2000 | Cormier |
| 6,175,971 | B1 | 1/2001 | O'Neill |
| 6,192,531 | B1 | 2/2001 | Fritz et al. |
| 6,192,532 | B1 | 2/2001 | Sesser et al. |
| 6,209,572 | B1 | 4/2001 | Wicklund |
| 6,289,532 | B1 | 9/2001 | Fritz et al. |
| 6,295,664 | B2 | 10/2001 | Fritz et al. |
| 6,349,975 | B1 | 2/2002 | Heil |
| 6,357,188 | B1 | 3/2002 | Lee et al. |
| 6,381,775 | B1 | 5/2002 | Sondrup |
| 6,405,502 | B1 | 6/2002 | Cornwall |
| 6,418,569 | B1 | 7/2002 | Knight |
| 6,546,573 | B1 | 4/2003 | Ball |
| 6,557,588 | B2 | 5/2003 | Wright |
| 6,595,243 | B2 | 7/2003 | Tarr |
| 6,637,050 | B1 | 10/2003 | Ball |
| 6,637,464 | B1 | 10/2003 | Cornwall |
| 6,687,925 | B2 | 2/2004 | Minnick |

(56) References Cited

U.S. PATENT DOCUMENTS

| | | | | |
|---|---|---|---|---|
| 6,691,411 | B2 | 2/2004 | Ball | |
| 6,694,684 | B2 | 2/2004 | Radke et al. | |
| 6,755,966 | B1 | 6/2004 | Reed | |
| 6,799,606 | B1 | 10/2004 | Howson | |
| 6,802,962 | B1 | 10/2004 | Browne, III et al. | |
| 6,890,427 | B2 | 5/2005 | Self et al. | |
| 6,945,733 | B2 | 9/2005 | Rathmann et al. | |
| 7,066,685 | B2 | 6/2006 | Humphries et al. | |
| 7,080,486 | B2 | 7/2006 | Radke et al. | |
| 7,127,752 | B2 | 10/2006 | Ball | |
| 7,191,794 | B2 | 3/2007 | Hodges | |
| 7,213,274 | B2 | 5/2007 | Cotton et al. | |
| 7,293,937 | B2 | 11/2007 | Fuchs et al. | |
| 7,370,663 | B2 | 5/2008 | Lundeberg et al. | |
| 7,503,083 | B2 | 3/2009 | Ball | |
| 7,524,133 | B2 | 4/2009 | Messerschmidt et al. | |
| 7,533,499 | B2 | 5/2009 | Daigger et al. | |
| 7,624,759 | B1 | 12/2009 | Ismert et al. | |
| 7,699,981 | B2 | 4/2010 | Ledford et al. | |
| 7,735,512 | B1 * | 6/2010 | Ismert et al. | 137/362 |
| 7,788,743 | B2 | 9/2010 | Mjelde et al. | |
| 7,797,892 | B2 | 9/2010 | Cannistraro et al. | |
| 7,878,110 | B1 | 2/2011 | Michnik et al. | |
| 7,964,095 | B1 | 6/2011 | Graybeal | |
| 7,992,236 | B2 | 8/2011 | Degooyer | |
| 8,028,357 | B2 | 10/2011 | Ball | |
| 8,043,497 | B2 * | 10/2011 | Silverstein et al. | 210/164 |
| 8,096,002 | B2 | 1/2012 | Stimpson et al. | |
| 8,166,584 | B2 | 5/2012 | Ball | |
| 8,188,382 | B2 | 5/2012 | Monden et al. | |
| 8,196,229 | B1 | 6/2012 | Hickok | |
| 8,230,535 | B2 | 7/2012 | Kik, Sr. et al. | |
| 8,347,424 | B2 * | 1/2013 | Wroblewski et al. | 4/288 |
| 8,347,906 | B1 | 1/2013 | Ismert et al. | |
| 8,566,976 | B2 * | 10/2013 | Evans et al. | 4/679 |
| 8,578,523 | B2 | 11/2013 | Eichler et al. | |
| 2001/0002494 | A1 | 6/2001 | Fritz et al. | |
| 2001/0003886 | A1 | 6/2001 | Mihalicz et al. | |
| 2003/0000012 | A1 | 1/2003 | Ball | |
| 2003/0098081 | A1 | 5/2003 | Tarr | |
| 2003/0150500 | A1 | 8/2003 | Molina | |
| 2004/0055083 | A1 | 3/2004 | Ball | |
| 2004/0068792 | A1 | 4/2004 | Ball | |
| 2004/0103474 | A1 | 6/2004 | Ball | |
| 2004/0200162 | A1 | 10/2004 | Wroblewski | |
| 2005/0005970 | A1 | 1/2005 | Lundeberg et al. | |
| 2005/0055916 | A1 | 3/2005 | Daigger et al. | |
| 2005/0092945 | A1 | 5/2005 | Heller et al. | |
| 2006/0159515 | A1 | 7/2006 | Messerschimidt et al. | |
| 2006/0171778 | A1 | 8/2006 | Fuchs et al. | |
| 2006/0283792 | A1 | 12/2006 | McCallum | |
| 2007/0034577 | A1 | 2/2007 | Bayard et al. | |
| 2007/0044218 | A1 | 3/2007 | Ball | |
| 2007/0050901 | A1 | 3/2007 | Hung | |
| 2007/0144954 | A1 | 6/2007 | Neuber | |
| 2007/0209109 | A1 | 9/2007 | Meyers | |
| 2007/0236002 | A1 | 10/2007 | Knight | |
| 2008/0078126 | A1 | 4/2008 | Ledford et al. | |
| 2008/0277324 | A1 | 11/2008 | Meyers | |
| 2009/0172877 | A1 | 7/2009 | Ball | |
| 2009/0223884 | A1 | 9/2009 | Wroblewski et al. | |
| 2009/0265850 | A1 | 10/2009 | Kuo | |
| 2010/0024107 | A1 | 2/2010 | Stimpson | |
| 2010/0126917 | A1 | 5/2010 | Wroblewski | |
| 2010/0133159 | A1 | 6/2010 | Priester | |
| 2010/0288685 | A1 | 11/2010 | Meyers | |
| 2010/0319281 | A1 | 12/2010 | Egan | |
| 2010/0320130 | A1 | 12/2010 | Meyers | |
| 2011/0067175 | A1 | 3/2011 | Steylaerts et al. | |
| 2011/0120924 | A1 | 5/2011 | Coscarella | |
| 2011/0173747 | A1 * | 7/2011 | Evans et al. | 4/679 |
| 2011/0203979 | A1 | 8/2011 | Schlueter | |
| 2011/0296606 | A1 | 12/2011 | Wedi | |
| 2012/0005824 | A1 | 1/2012 | Ball | |
| 2012/0036630 | A1 | 2/2012 | Cook | |
| 2012/0036631 | A1 | 2/2012 | Cook | |
| 2012/0036632 | A1 | 2/2012 | Cook | |
| 2012/0037553 | A1 | 2/2012 | Silverstein et al. | |
| 2013/0160203 | A1 | 6/2013 | DeGooyer et al. | |
| 2013/0206247 | A1 | 8/2013 | Wroblewski et al. | |

FOREIGN PATENT DOCUMENTS

| | | | |
|---|---|---|---|
| DE | 19951696 | A1 | 5/2001 |
| DE | 10210496 | C1 | 4/2003 |
| EP | 0198385 | A2 | 10/1986 |
| EP | 0816580 | A2 | 1/1998 |
| JP | 8158439 | A | 6/1996 |

OTHER PUBLICATIONS

Zurn Industries Specification Sheet for "Z1726 Adjustable Floor Drain Medium Duty," (Nov. 15, 2010).

Zurn Industries Typical Installation Instructions for "Z-1400-KC 'Level-Trol' Floor Cleanout."

Zurn Industries Hydromechanics Handbook, cover and pp. 26, 29 (1962).

Zurn Industries "Z400B-RA Rough-In Adapter" product literature and installation instructions.

Zurn Industries "Z415( )-RA 'Type B' and 'Type S' Strainer Heads" installation instructions (Jun. 2, 2010).

MIFAB "Allstar Covers" product literature (2012).

Jones Stephens Corp."LevelBest" product literature (2012).

Jones Stephens Corp. "PlumBest/LevelBest" product information (2012).

* cited by examiner

ROUGH-IN ADAPTER

CROSS REFERENCE TO RELATED APPLICATIONS

The present application claims priority from U.S. Provisional Patent Application No. 61/720,447 filed on Oct. 31, 2012, and U.S. Provisional Patent Application No. 61/886,319 filed on Oct. 3, 2013, both of which are incorporated herein by reference in their entireties.

BACKGROUND OF THE INVENTION

1. Field of the Invention

The present invention relates to a drain assembly for installation in a finished floor surface. More particularly, the present invention relates to an adjustable drain assembly that is configured to allow for positioning of a strainer at the same level of the finished floor surface at the time of installation.

2. Description of Related Art

Typical drain assemblies or drain fixtures are installed in a finished floor surface, such as a finished concrete floor or a tiled floor, to drain water or other liquids from a top surface of the floor and allow the liquid to flow into an underlying drain pipe. Typical drain assemblies include a drain body connected to the drain pipe and a drain head connected to the drain body. The drain head may include a grate or strainer at the top thereof to prevent large pieces of debris from entering and clogging the drain pipe.

The drain head typically includes a threaded portion that is threadably attached to the drain body or directly to the drain pipe. The height of the drain head may be minimally adjusted up or down by threading the drain head further into or out of the drain body or drain pipe.

During installation, the drain body and drain head are installed upon the drain pipe prior to pouring the surrounding concrete slab that defines the primary floor surface. Ideally, the drain is installed at the proper height to allow for proper drainage and so that the strainer or grate will be positioned flush with the final floor surface, i.e., at the same level as the finished concrete flooring or with any supplemental flooring, such as tiles, installed on top of the concrete slab. Because the drain body and the drain head must be installed prior to construction of the finished flooring, the drain assembly is subject to infiltration by debris, which requires cleaning after completion of the flooring, and damage during construction.

Further, once the finished concrete slab is constructed and set, it is usually impossible to raise or lower the level of the drain head and/or strainer without removing finished concrete from the area of the drain assembly.

SUMMARY OF THE INVENTION

Accordingly, there is a general need in the art for a drain assembly that allows for a void to be created in a finished concrete slab to allow for installation of a drain head after completion of the concrete slab so that the height of the drain head can be easily adjusted both during and after installation. There is also a general need in the art for a drain head that allows for easy installation of different strainers or grates on a drain assembly during and after installation.

According to one particular embodiment of the invention, a drain assembly is provided. The drain assembly includes a drain body configured to be connected to a drain pipe such that the drain body is in fluid communication with the drain pipe; and a drain head assembly adjustably connected to the drain body such that the drain head assembly is in fluid communication with the drain body. The drain head assembly includes a shank adjustably connected to the drain body; and a strainer assembly connected to a top of the shank, the strainer assembly including a strainer, an upper frame, and a lower frame connected to each other. The lower frame includes a connection feature configured to non-threadably and removably connect the strainer assembly to the top of the shank.

According to another particular embodiment of the invention, a drain assembly is provided. The drain assembly includes a drain body configured to be connected to a drain pipe such that the drain body is in fluid communication with the drain pipe; a drain head assembly adjustably connected to the drain body such that the drain head assembly is in fluid communication with the drain body, the drain head assembly including a shank adjustably connected to the drain body; and a cover configured to be removably connected to the shank in a position over the shank and to at least partially define a void in a poured concrete slab around the shank.

According to yet another particular embodiment of the invention, a method of installing a drain assembly in a finished floor surface is provided. The method includes providing a drain assembly. The drain assembly includes a drain body; a drain head assembly adjustably connected to the drain body such that the drain head assembly is in fluid communication with the drain body, the drain head assembly including a shank and a strainer assembly configured to be connected to a top of the shank; and a cover configured to be removably connected to the shank in a position over the shank. The method further includes adjustably connecting the shank of the drain head assembly to the drain body; connecting the drain body to a drain pipe such that the drain body is in fluid communication with the drain pipe; connecting the cover to the shank in the position over the shank; adjusting a height of the cover and the shank with respect to the drain body such that the cover is positioned at a level flush with an intended height of the finished floor surface; pouring a concrete slab around the cover and over the drain body such that the cover at least partially defines a void in the poured concrete slab around the shank; removing the cover from the shank; and connecting the strainer assembly to the top of the shank.

Further details and advantages of the invention will become clear upon reading the following detailed description in conjunction with the accompanying drawing figures, wherein like parts are designated with like reference numerals throughout.

DETAILED DESCRIPTION OF THE INVENTION

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

Figure 1:
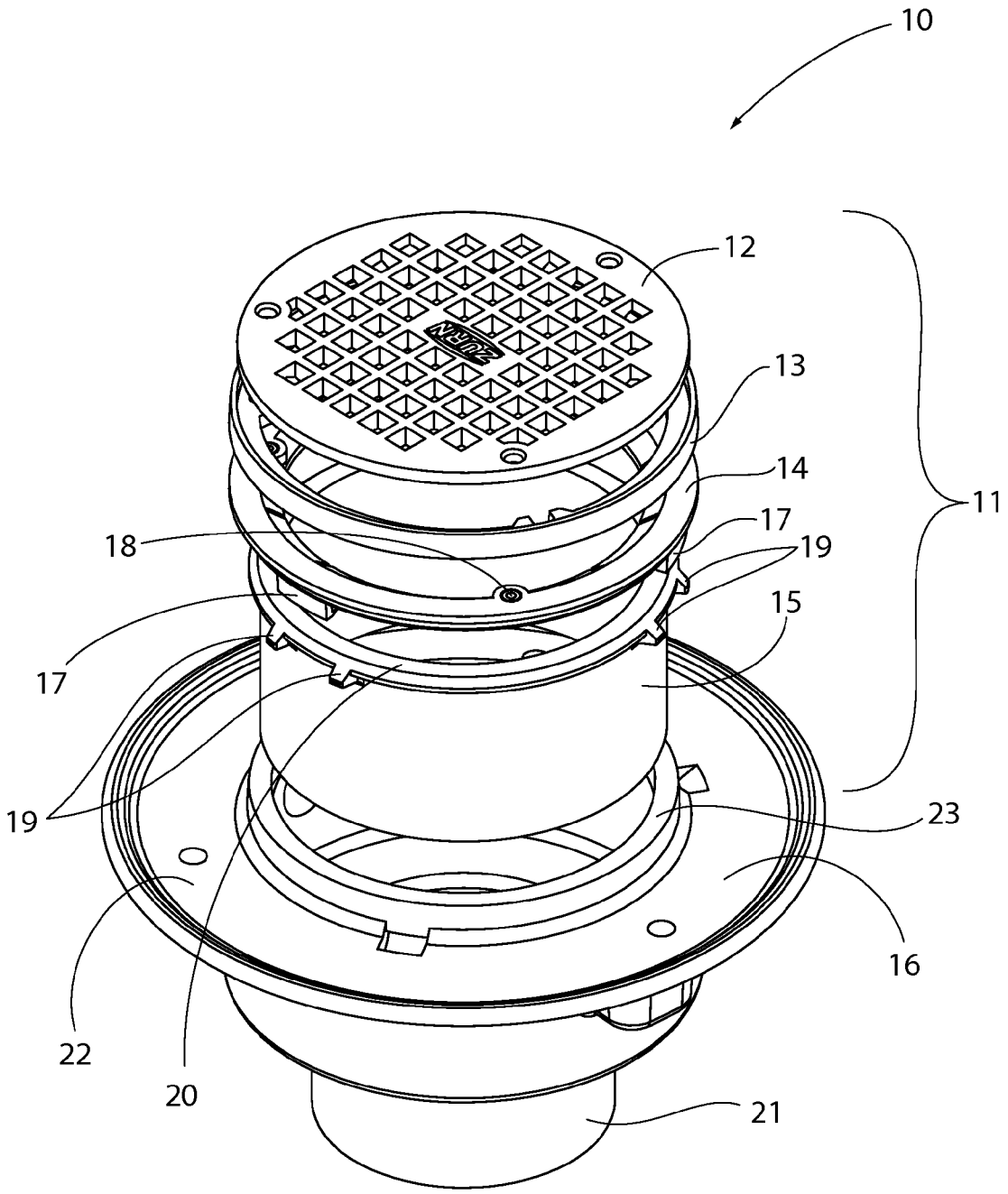
FIG. 1 is an exploded perspective view of a drain assembly in accordance with an embodiment of the present invention.
Figure 2:
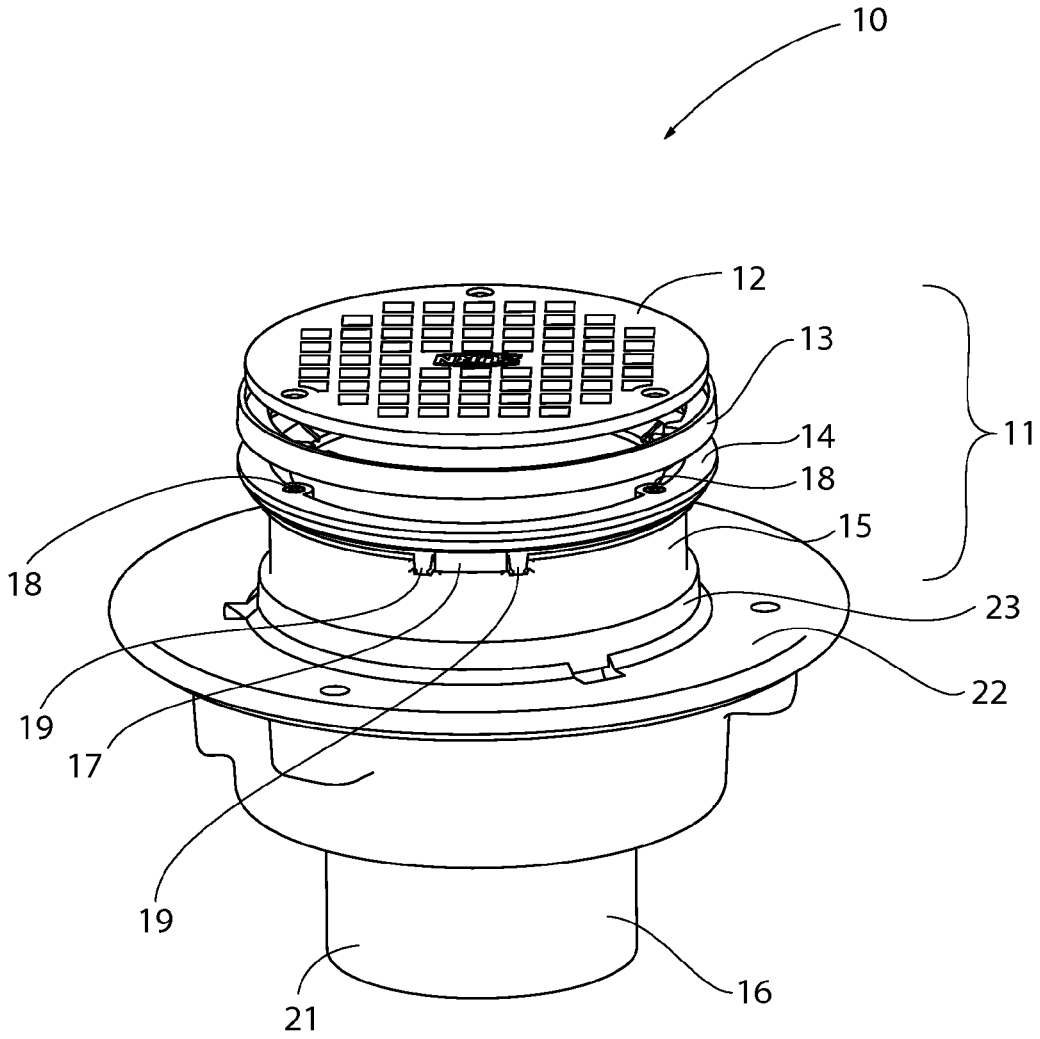
FIG. 2 is another exploded perspective view of the drain assembly of FIG. 1.
Figure 3:
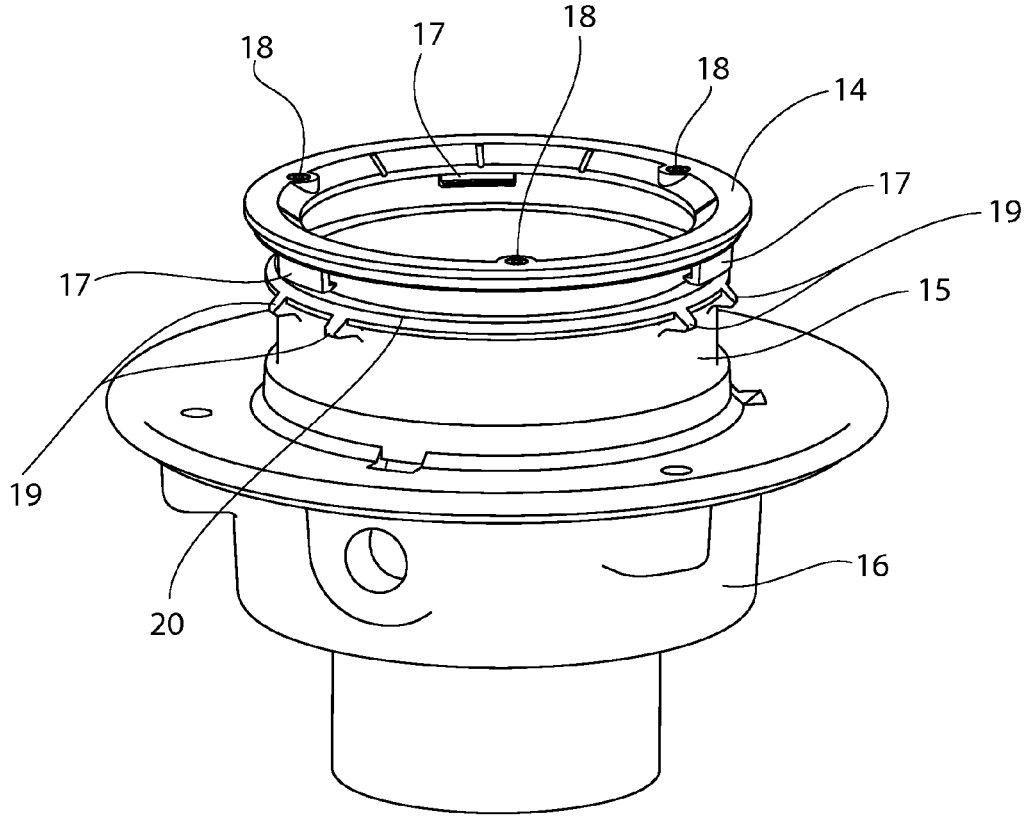
FIG. 3 is an exploded view of the lower frame and the shank of the drain assembly of FIG. 1.
Figure 4A:
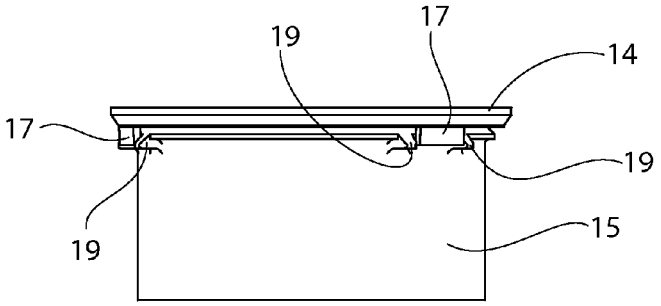
FIGS. 4*a*, 4*b*, and 4*c* are a series of views illustrating the engagement between the lower frame and the shank of the drain assembly of FIG. 1.
Figure 4B:
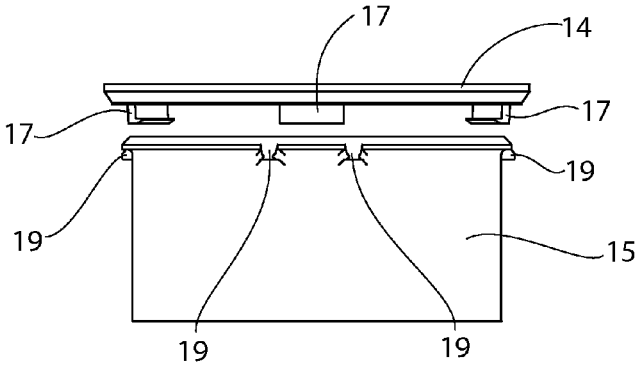
Figure 4C:
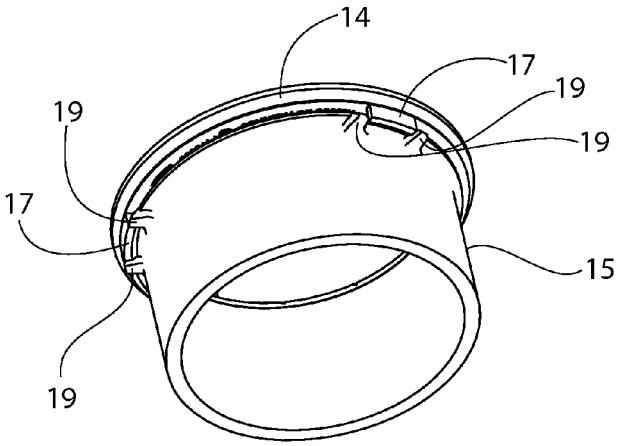
Figure 4D:
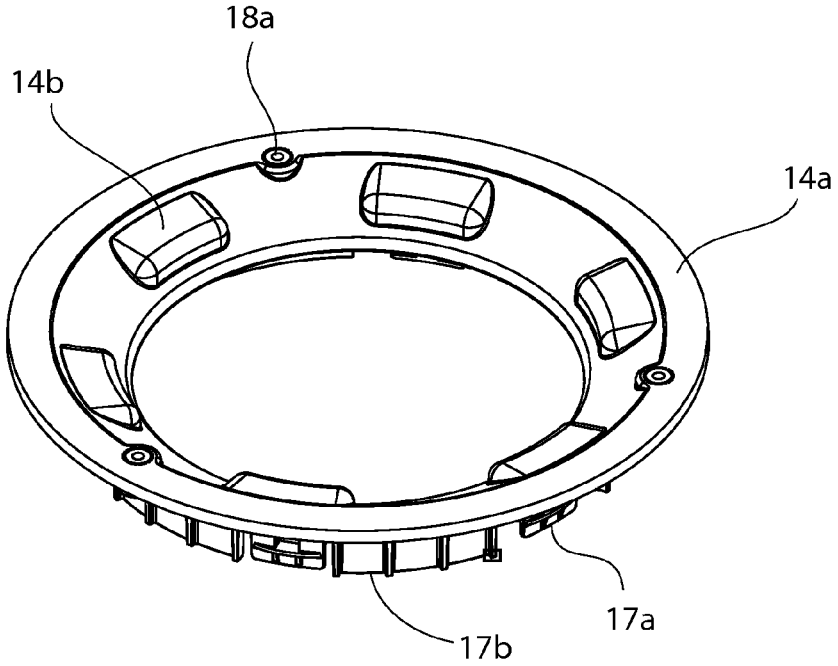
FIGS. 4D-4M are a series of views illustrating an alternative embodiment of a lower frame of the drain assembly of FIG. 1 and illustrating the engagement between the lower frame and the shank of the drain assembly of FIG. 1.
Figure 4E:
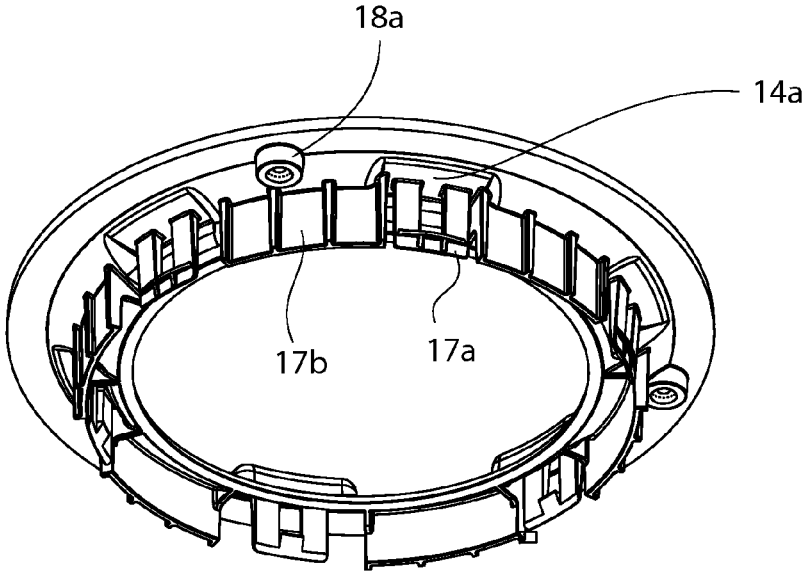
Figure 4F:
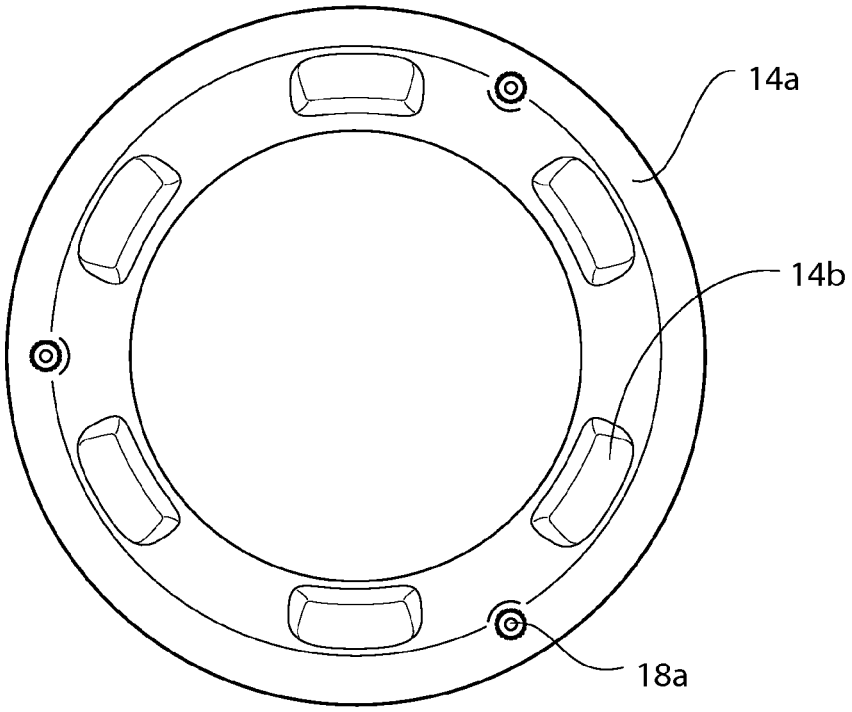
Figure 4G:
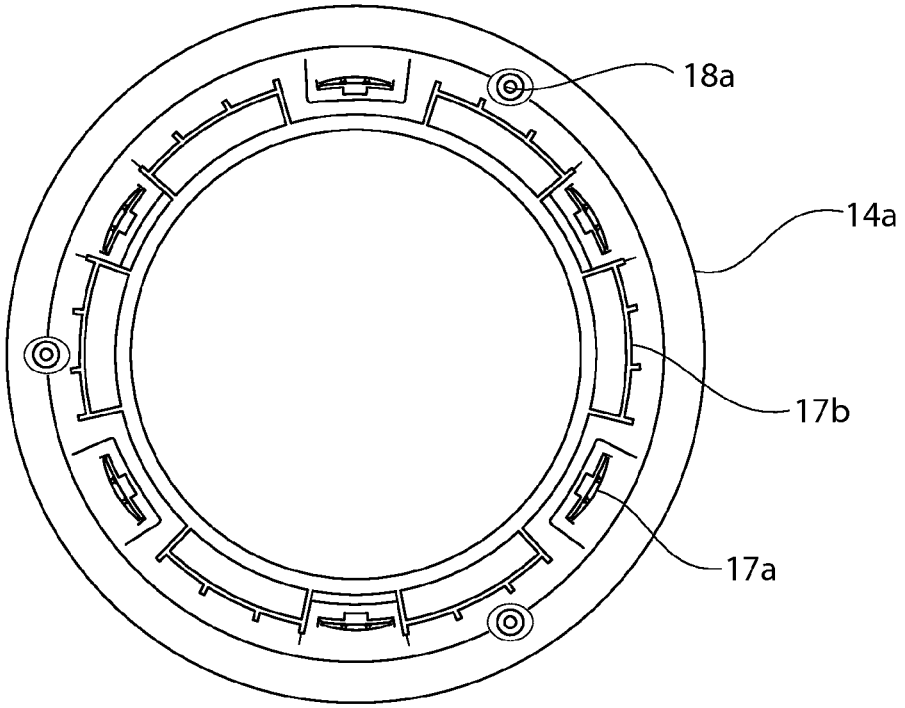
Figure 4H:
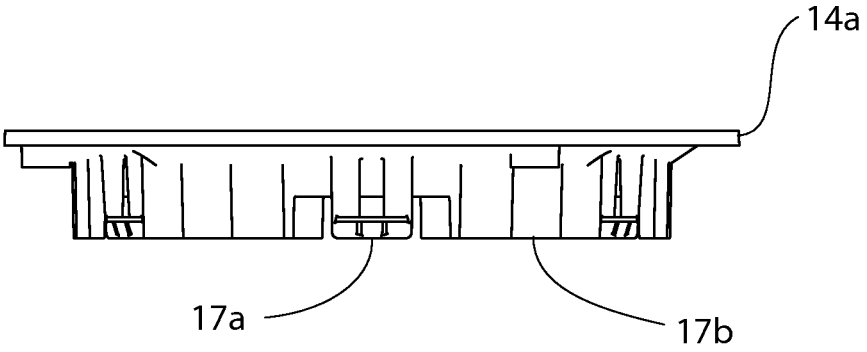
Figure 4I:
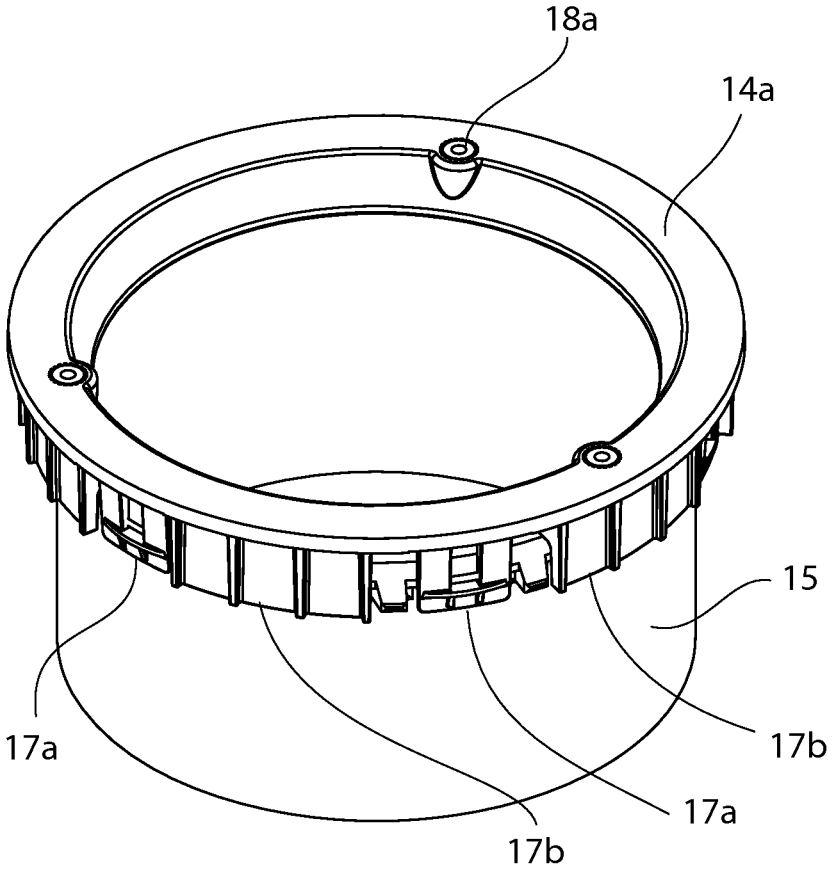
Figure 4J:
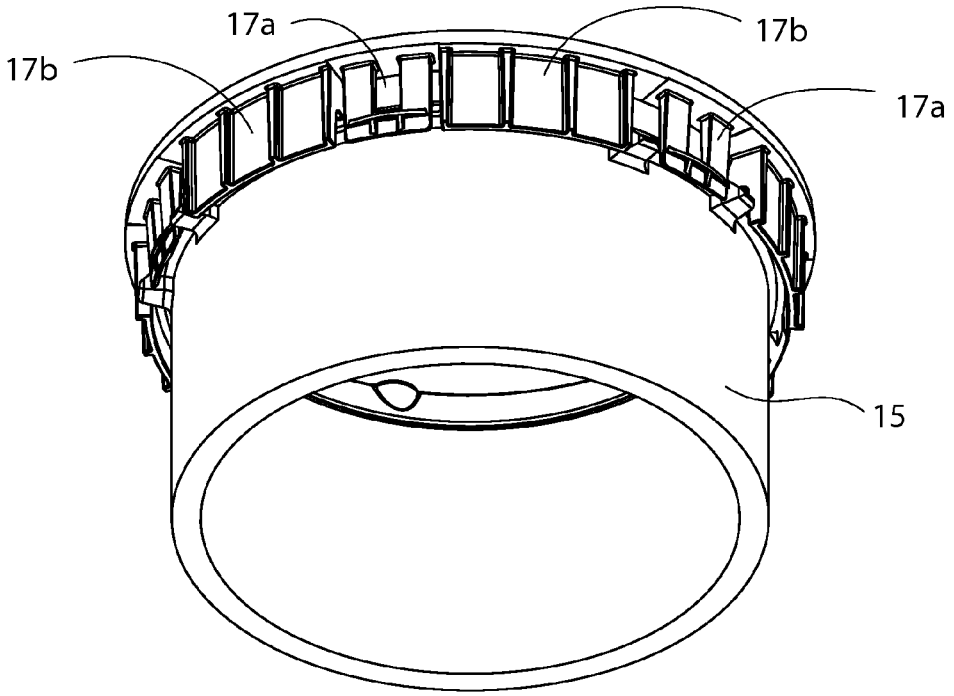
Figure 4K:
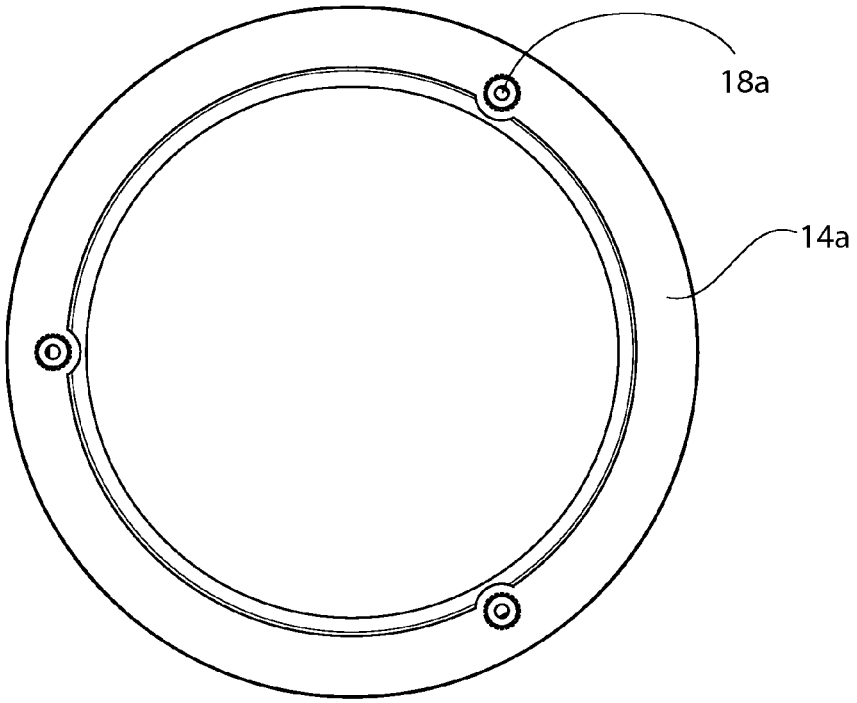
Figure 4L:
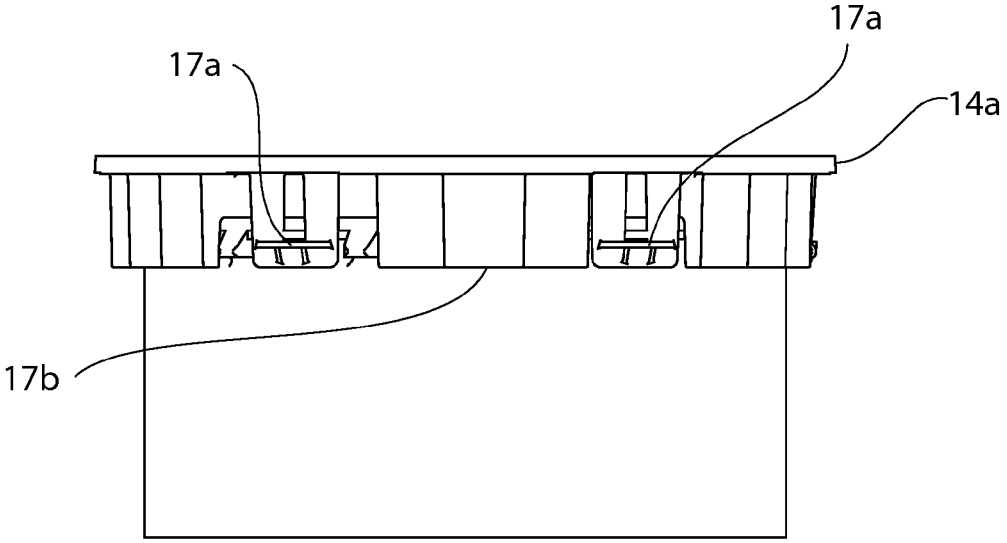
Figure 4M:
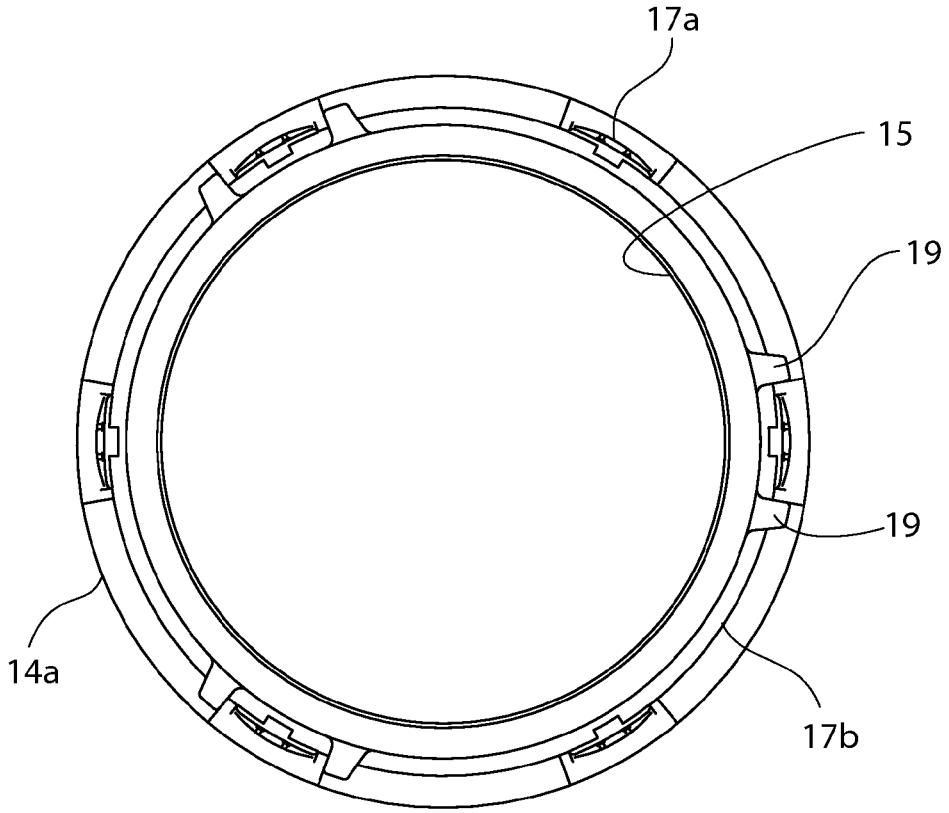

With reference to FIGS. 1-4*c* and 5, a drain assembly 10 for installation in a finished floor surface 29 is shown in accordance with an embodiment of the present invention. As shown in FIGS. 1 and 2, the drain assembly 10 includes a drain head assembly 11 adjustably connected to a drain body 16. The drain head assembly 11 includes a shank 15 and a strainer assembly that includes a strainer 12, an upper frame 13, and a lower frame 14 connected to the shank 15. The strainer 12 and upper frame 13 may be constructed of metal, with the strainer 12 being positioned inside the upper frame 13. The lower frame 14 may be constructed of a plastic material. The shank 15 may be constructed from plastic or cast iron material. When assembled, the upper frame 13 will rest on the top surface of the lower frame 14, and the strainer 12, upper frame 13, and lower frame 14 are secured to each other by fasteners, such as machine screws, that are inserted through the strainer 12 and the upper frame 13, and threaded into the lower frame 14. To that end, the lower frame 14 includes threaded holes 18 extending therethrough. The threaded holes 18 may be directly formed in the lower frame 14 or may be inserts made from a durable material, such as metal, that are molded into the lower frame 14. As can be appreciated by one having ordinary skill in the art, the strainer 12, upper frame 13, and lower frame 14 may also be secured to each other by any suitable means, other than machine screws and threads.

The strainer assembly is fastened together and shipped as a single unit, and then assembled onto the drain assembly 10 during installation. It is to be appreciated that the strainer 12, upper frame 13, lower frame 14, and the shank 15 may be made from any material(s) known to be suitable to those having ordinary skill in the art. Also, various configurations in the assembly of the strainer assembly are also possible. For instance, the upper frame 13 and the lower frame 14 may be combined into a single piece, with the strainer 12 fastened to the single frame piece.

As shown in FIGS. 1-4*c*, the lower frame 14 includes a connection feature that allows the lower frame 14 and, thus, the entire strainer assembly, to be non-threadably connected to a top end of the shank 15 to allow for easy assembly and removal of the strainer assembly from the shank 15. In particular, the lower frame 14 includes at least two, and particularly three, equally circumferentially-spaced snap-on hooks 17 extending from a bottom surface of the lower frame 14. The shank 15 includes at least two, and particularly three, complementary sets of lugs 19 at a top end thereof extending outward from a top ring 20 of the shank 15. When the strainer assembly is assembled onto the shank 15, the lower frame 14 is pressed down over the top surface of the shank 15 until the hooks 17 grab on to the top ring 20 formed at the top end of the shank 15 by bending outward and snapping over and onto the top end of the shank 15. Each set of lugs 19 engages a respective one of the flexible hooks 17. The lugs 19 are provided so that, when the lower frame 14 is assembled onto the threaded shank 15, the hooks 17 may be positioned between the lugs 19 to prevent rotation of the lower frame 14 and the strainer assembly with respect to the threaded shank 15.

Accordingly, it is to be appreciated that a variety of shapes and configurations of the strainer 12, upper frame 13, and lower frame 14 may be provided and used with a common or standard threaded shank 15 since the lower frame 14 is connected to the top end of the threaded shank 15 without the use of fasteners or other specialized hardware. In particular, the top flange geometry of the lower frame 14 may be molded into a plurality of sizes and configurations to accommodate a variety of strainers 12 and upper frames 13. For instance, the lower frame 14 can be molded into various shapes, such as round or square, and into a variety of sizes to accommodate various finished assemblies of strainers 12 and upper frames 13. Thus, the threaded shank 15 may be made standard and compatible with a variety of different configurations of the strainer assembly. Further, the threaded shank 15 may be replaced or reused without requiring replacement or reuse of a strainer assembly, and vice versa.

It is to be appreciated that the connection feature that allows for assembly of the lower frame 14 onto the threaded shank 15 may be of any configuration known to be suitable to those having ordinary skill in the art. According to an alternative embodiment of the present invention, the connection feature is a bayonet-type attachment mechanism, wherein one of the lower frame 14 or the threaded shank 15 includes lugs that engage within a circumferential groove formed in the other of the lower frame 14 or the threaded shank 15.

Figure 5:
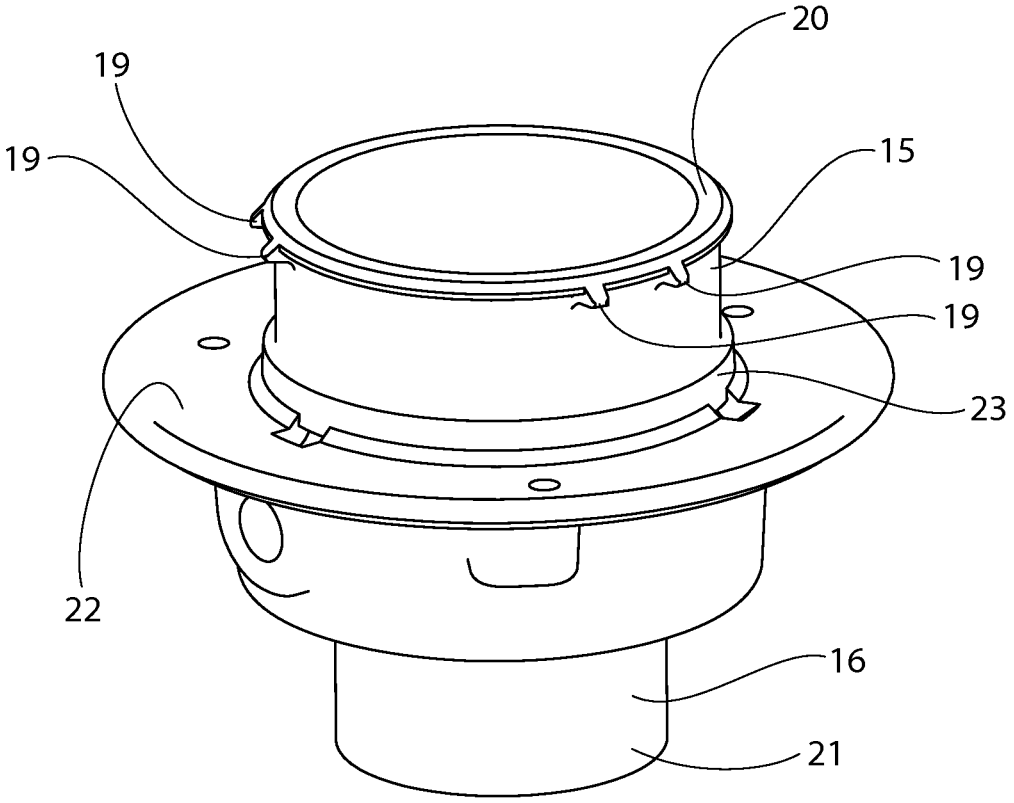
FIG. 5 is a perspective view of the shank and the drain body of the drain assembly of FIG. 1.

As shown in FIGS. 1, 2, and 5, the drain body 16 includes a bottom outlet 21 that connects to a drain pipe (not shown), such that drain body 16 is in fluid communication with the drain pipe, and a lid 22 fastened to the outlet 21 in a standard configuration. The drain body 16 may be made from plastic or cast iron or other suitable materials. The lid 22 includes a protruding horn 23 thereon that has female threads on an inside surface thereof. The shank 15 includes external male threads on an outside surface thereof, such that the shank 15 may be threadably and adjustably connected to the drain body 16 such that the drain head assembly 11 is in fluid communication with the drain body 16 and installed to the required height with respect to the drain body 16 and the finished floor surface. It is to be appreciated that the shank 15 may be adjustably connected to the drain body 16 by suitable means other than a threaded connection. For instance, the shank 15 may be slidably connected to the drain body 16 and then locked in a vertical position by a suitable mechanism, or the shank 15 may include a plurality of notched steps that rest on lugs formed within an interior diameter of the drain body 16.

With reference to FIGS. 4D-4M, an alternative embodiment of a lower frame 14*a* is shown. The lower frame 14*a* includes six circumferentially spaced, flexible snap hooks 17*a* extending from a bottom surface of the lower frame 14*a*. The flexible snap hooks 17*a* are interspaced by circumferential walls 17*b* that also extend from the bottom surface of the lower frame 14*a*. The flexible snap hooks 17*a* are lengthened in comparison to the snap hooks 17 discussed above with reference to FIGS. 1-4*c* in order to provide greater flexibility. The circumferential walls 17*b* extend a similar length as the flexible snap hooks 17*a*. The provision of six snap hooks 17*a* to the lower frame 14*a* results in additional pull force resistance being provided to the lower frame 14*a*. Three of the hooks 17*a* engage the top ring 20 of the shank 15 within the lugs 19 to prevent rotation of the lower frame 14*a*, as discussed above. The other three snap hooks 17*a* engage the top ring 20 of the shank 15 for additional support.

As shown in FIGS. 4I-4M, the top ring 20 of the shank 15 fits within the perimeter defined by the snap hooks 17*a* and the circumferential walls 17*b*. In this manner, the circumferential walls 17*b* are positioned to resist shear force applied to the snap hooks 17*a* that may occur during usage and prevent forces from being applied to and damaging or breaking the snap hooks 17*a*. The snap hooks 17*a* may also include reinforcement ribs to prevent breakage. Protruding bumps 14*b* may be formed in the lower frame 14*a* in order to promote making the snap hooks 17*a* with a longer length. The bumps 14*b* may be configured to have a tapered surface to prevent standing water from collecting on the lower frame 14*a*. The lower frame 14*a* is installed on the shank 15 in the same manner as discussed above with respect to the lower frame 14. The lower frame 14*a* also includes threaded holes 18*a* to allow the upper frame 13 and strainer 12 to be fastened to the lower frame, also in the same manner as discussed above.

Figure 6:
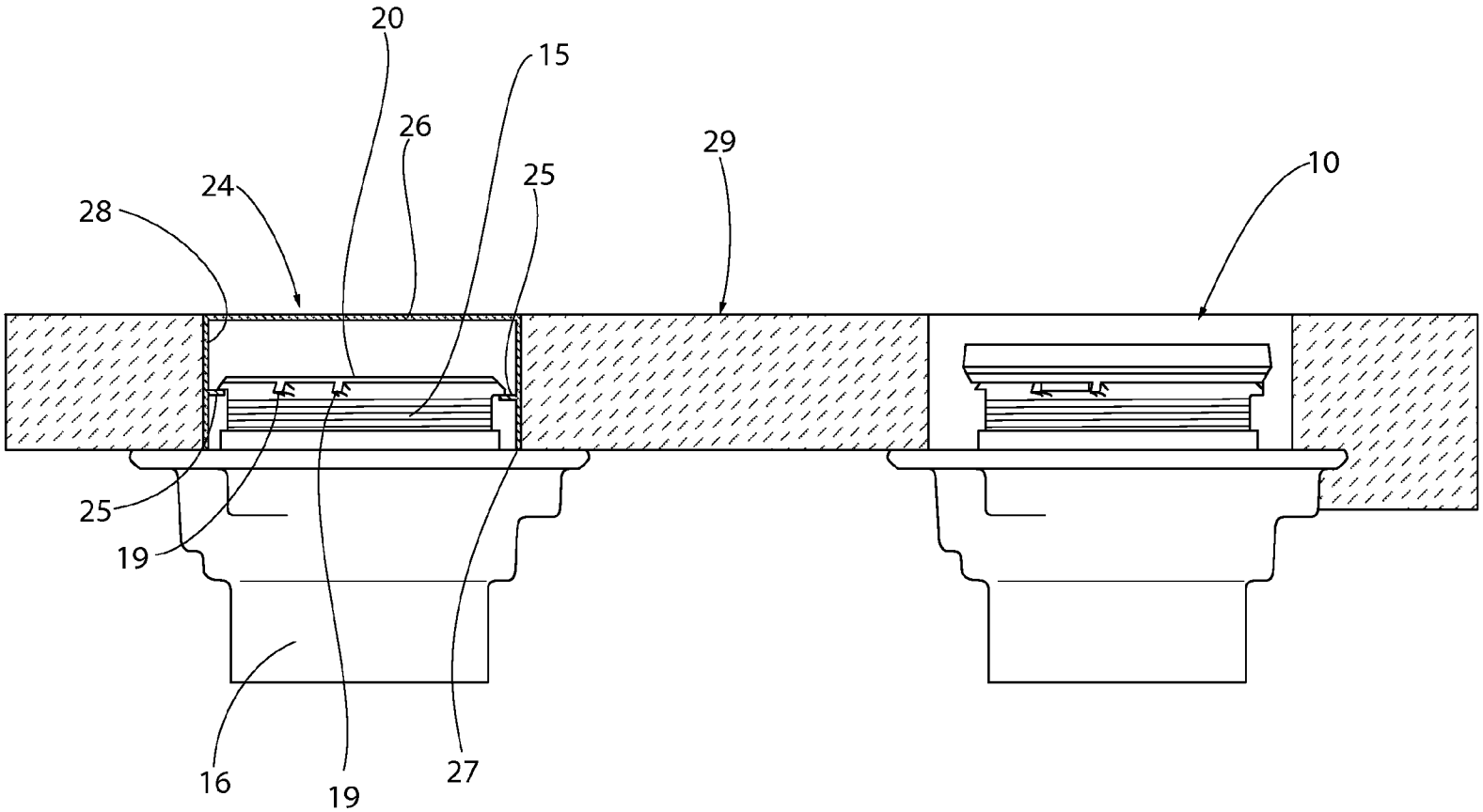
FIG. 6 is a schematic representation illustrating the installation of the drain assembly of FIG. 1 in a finished floor surface.

With reference to FIG. 6, the drain assembly 10 is installed in the finished floor surface 29 with the aid of a rough-in cover 24. As shown, during construction, the drain body 16 and the threaded shank 15 are connected to the drain pipe within the subflooring. The rough-in cover 24 is then positioned on the drain body 16 and over the shank 15 such that a bottom 27 of the cover 24 is in engagement with the lid 22 of the drain body 16, and the threaded shank 15 is within an interior of the cover 24. The cover 24 includes hooks 25 or other features extending from an interior surface 28 thereof that engages the top of the shank 15 to removably connect the cover 24 to the shank 15 in the same manner as the lower frame 14 discussed above. Thus, the threaded shank 15 and the rough-in cover 24 can be installed on to the drain body 16 and then adjusted to the required height, such that a top surface 26 of the rough-in cover 24 is positioned at a level flush with the intended height of the finished floor surface 29. The concrete slab can then be poured around the cover 24 and over the drain body 16, such that the cover 24 at least partially defines a void in a poured concrete slab of the finished floor surface 29 that allows for installation and adjustment of the drain head assembly 11. In particular, because the cover 24 is positioned over and surrounds the shank 15 and extends to engage the lid 22 of the drain body 16, the cover 24 fully defines the void. To that end, an expansible sealing material (not shown) may be provided between the bottom 27 of the cover 24 and the lid 22 of the drain body 16 to prevent infiltration of poured concrete material therebetween during the pour.

Once the concrete slab is poured and the finished floor surface 29 completed, the rough-in cover 24 can be removed from the shank 15, which remains adjustable with respect to the drain body 16, and the strainer assembly of the strainer 12, upper frame 13, and lower frame 14 can be connected to the top of the threaded shank 15 in the manner discussed above. The drain head assembly 11 can be adjusted to the proper height such that the strainer 12 is flush with the finished floor surface 29.

Figure 7:
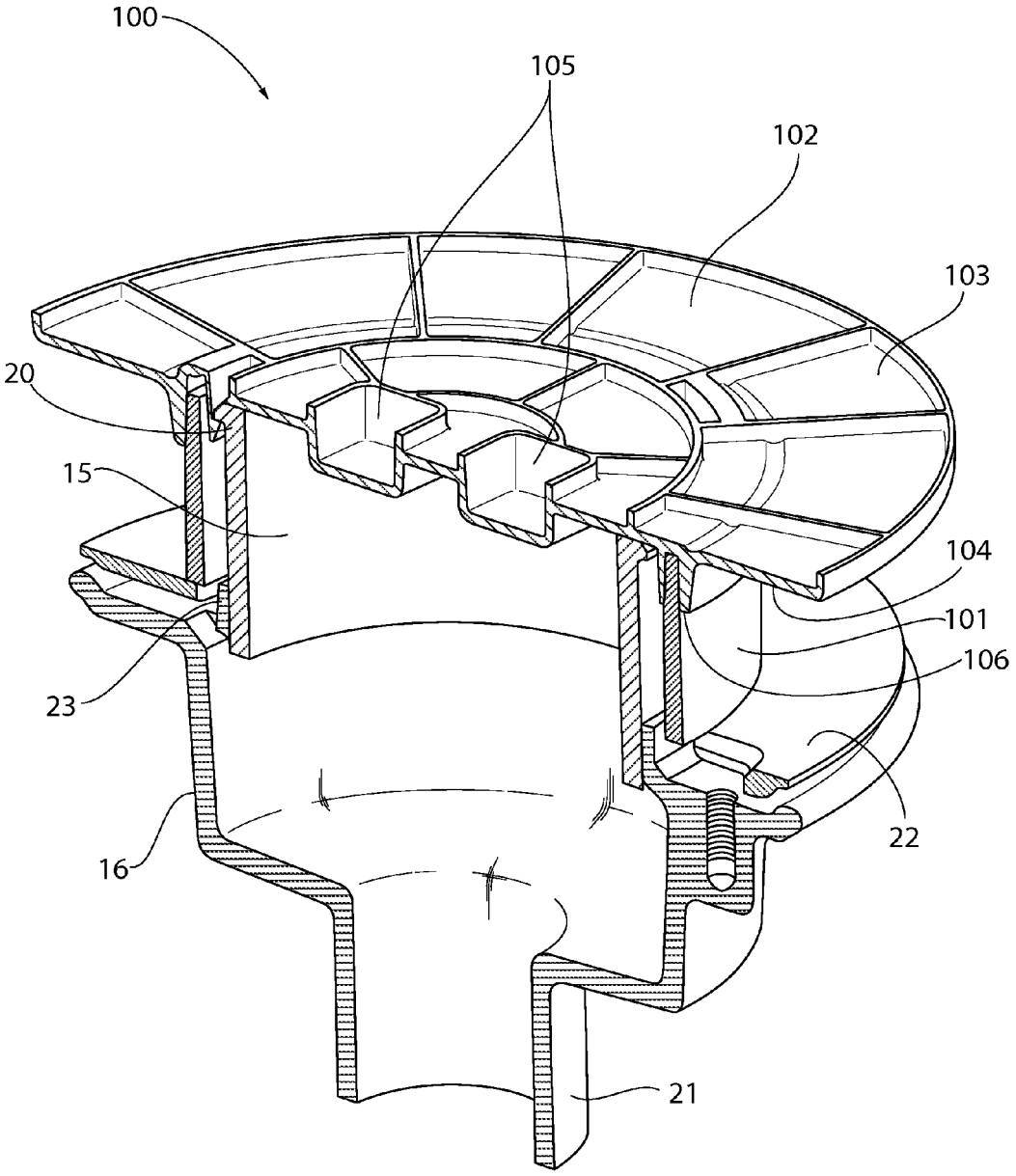
FIG. 7 is a cross-sectional perspective view of a cover assembly in accordance with another embodiment of the present invention connected to the shank and drain body of the drain assembly of FIG. 1.
Figure 8:
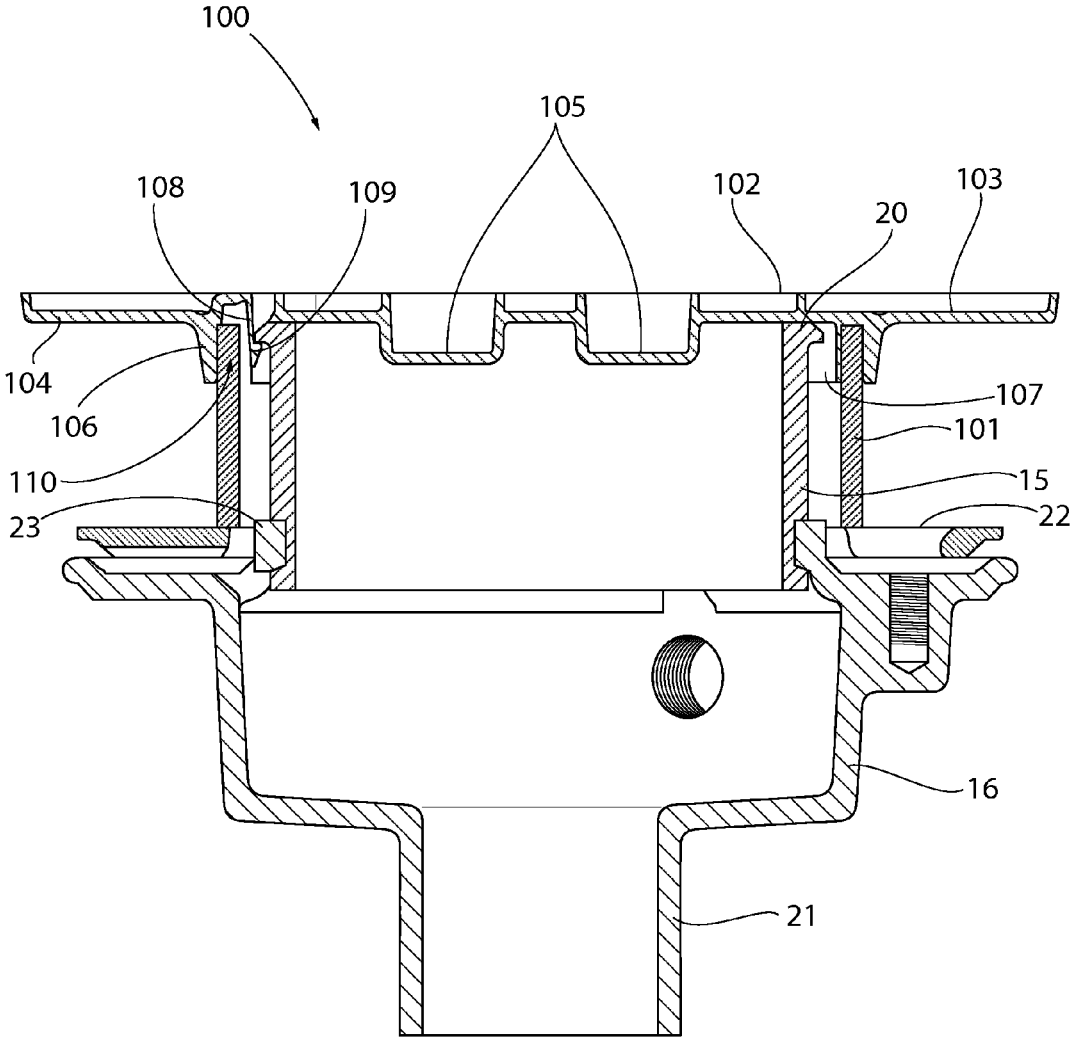
FIG. 8 is a cross-sectional side view of the cover assembly of FIG. 7 connected to the shank and drain body of the drain assembly of FIG. 1.

With reference to FIGS. 7-12, a cover assembly 100 for use as a rough-in cover is shown in accordance with another embodiment of the present invention. As shown in FIGS. 7 and 8, the cover assembly 100 is configured to be installed on the drain body 16 to surround the shank 15 prior to pouring of the concrete slab around the drain assembly. The cover assembly 100 includes a protector sleeve 101 and a cover 102. The cover 102 has a top surface 103 and a bottom 104, and is configured to be positioned over the shank 15. In particular, the cover 102 is positioned on and removably connected to the top of the shank 15.

The protector sleeve 101 is positioned between the bottom 104 of the cover 102 and the lid 22 of the drain body 16, and surrounding the shank 15. The protector sleeve 101 may be made from a flexible foam material so that it becomes compressed between the cover 102 and the drain body 16 during assembly and prevents the intrusion of concrete between the cover 102 and the drain body 16 to the shank 15 while concrete is poured around the drain body 16 and the cover assembly 100. In this manner, the cover 102 and the protector sleeve 101 in combination define a void in the poured concrete slab to allow for installation and adjustment of the drain head assembly 11.

At least one projection 106, 107, 108 is disposed on the bottom 104 of the cover 102 for engaging the protector sleeve 101 to retain the position of the protector sleeve 101 and for engaging the shank 15 to removably connect the cover 102 to the shank 15. More specifically, the bottom 104 of the cover 102 includes an outer annular projection 106 forming a ring within the outer perimeter of the cover 102. The bottom 104 of the cover 102 also includes a plurality of inner arc-shaped projections 107 that are substantially concentric with the outer annular projection 106, and at least two inner flexible projections 108 that are substantially aligned with the diameter of the arc-shaped projections 107 and may also be arc-shaped concentric with the inner arc-shaped projections 107 and the outer annular projection 106. In this manner, the inner arc-shaped projections 107 and the inner flexible projections 108 form an inner ring within the diameter of the outer ring defined by the outer annular projection 106. The inner and outer rings define a channel 110 between them and are configured to engage the protector sleeve 101 to retain the protector sleeve 101 within the channel 110 in its position surrounding the shank 15, and to prevent the intrusion of poured concrete to the shank 15. The inner flexible projections 108 may include snap hooks 109 on the lower ends thereof and are configured to engage the top ring 20 of the shank 15 so that the cover 102 is removably connected to the top of the shank 15.

During construction, the drain body 16 and the threaded shank 15 are connected to the drain pipe within the subflooring. The rough-in cover assembly 100 is then installed onto the drain body 16 and over the threaded shank 15 such that the protector sleeve 101 is retained within the channel 110 formed between the projections 106, 107, 108 on the bottom 104 of the cover 102 and positioned between the bottom 104 of the cover 102 and the lid 22 of the drain body 16 to surround the threaded shank 15, and such that the cover 102 is removably connected to the threaded shank 15 via the engagement of the flexible projections 108 with snap hooks 109 and the top ring 20 of the threaded shank 15. Thus, the threaded shank 15 and the rough-in cover assembly 100 can be installed on to the drain body 16 and then adjusted to the required height, such that the top surface 103 of the rough-in cover 102 is positioned at a level flush with the intended height of the finished floor surface. The concrete slab can then be poured around the cover assembly 100 and the drain body 16, such that the cover assembly 100 defines a void in the finished floor surface that allows for installation and adjustment of the drain head assembly 11.

Once the concrete slab is poured and the finished floor surface completed, the rough-in cover assembly 100 can be removed from the threaded shank 15, which remains adjustable with respect to the drain body 16, and the strainer assembly of the strainer 12, upper frame 13, and lower frame 14 can be connected to the top of the threaded shank 15 in the manner discussed above. The drain head assembly 11 can be adjusted to the proper height such that the strainer 12 is flush with the finished floor surface. The top surface 103 of the cover 102 may include a notch or recess 105 to facilitate removal of the cover 102 from the finished concrete slab.

It is to be appreciated that the configuration of the cover 102 and the projections 106, 107, 108 may be altered in any manner known to be suitable to one having ordinary skill in the art so as to engage and retain the protector sleeve 101 between the cover 102 and the drain body 16, and to removably connect the cover 102 to the top of the threaded shank 15. The cover 102 may also be configured to have additional material thickness or the thickness may be increased by applying a layer of foam to the bottom 104 of the cover 102 so as to increase the size of the void in the poured concrete slab created by the cover 102 and facilitate access to the threaded shank 15 for installation and adjustment of the drain head assembly 11.

Figure 8A:
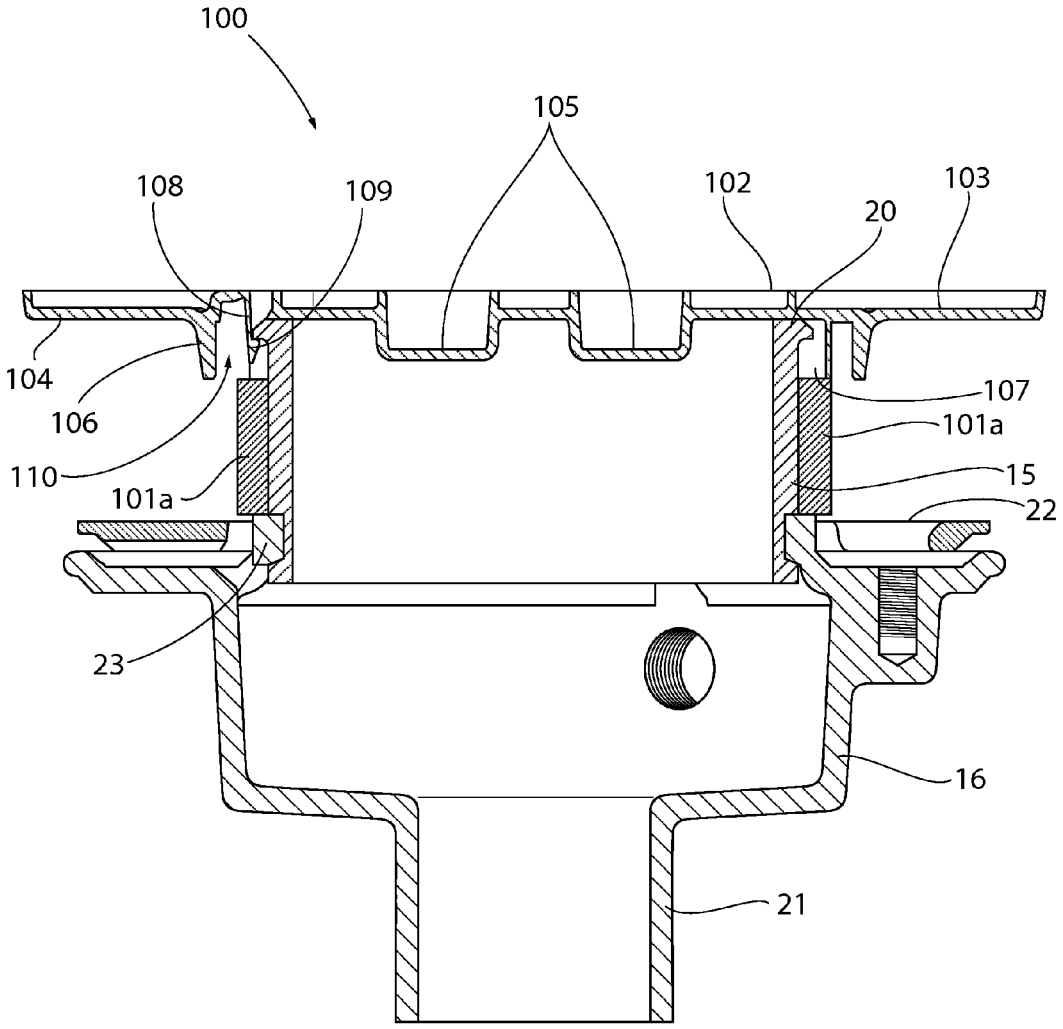
FIG. 8A is a cross-sectional side view of the cover assembly of FIG. 7 according to an alternative embodiment of the present invention connected to the shank and drain body of the drain assembly of FIG. 1.
Figure 9:
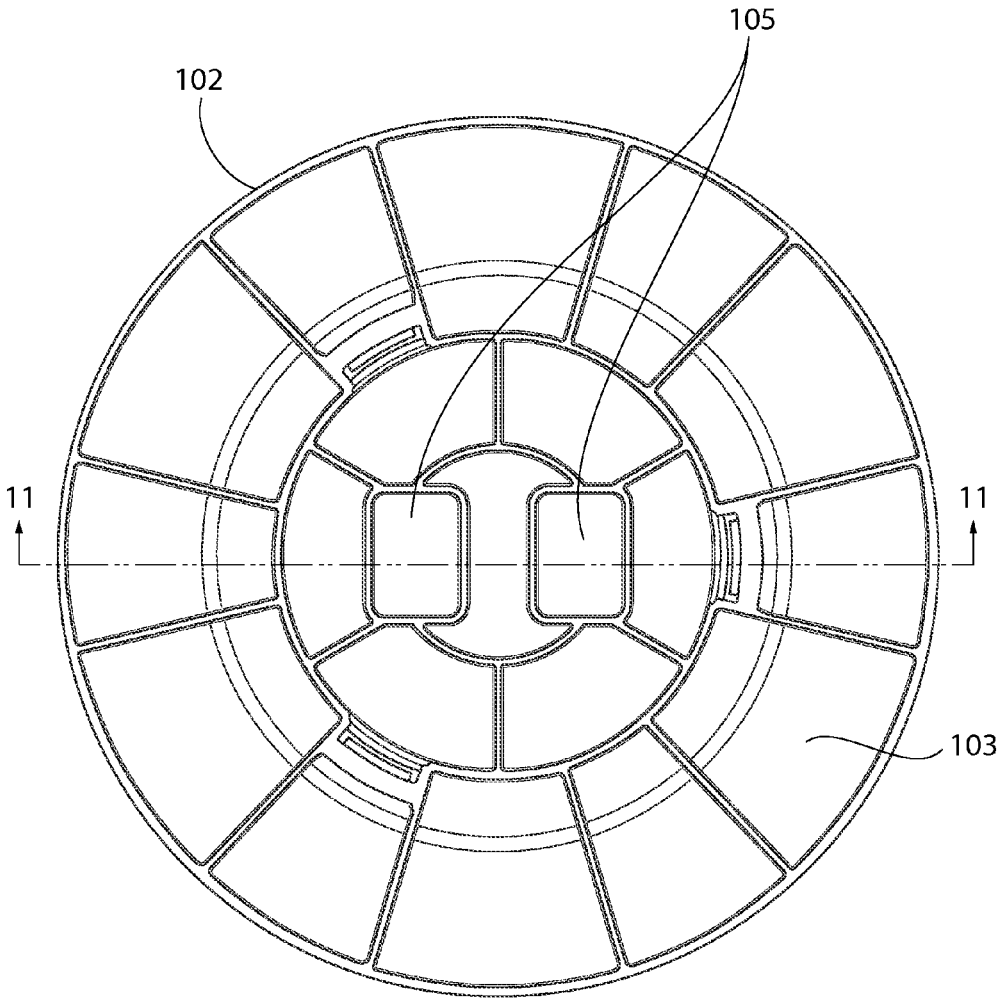
FIG. 9 is a top view of a cover of the cover assembly of FIG. 7.
Figure 10:
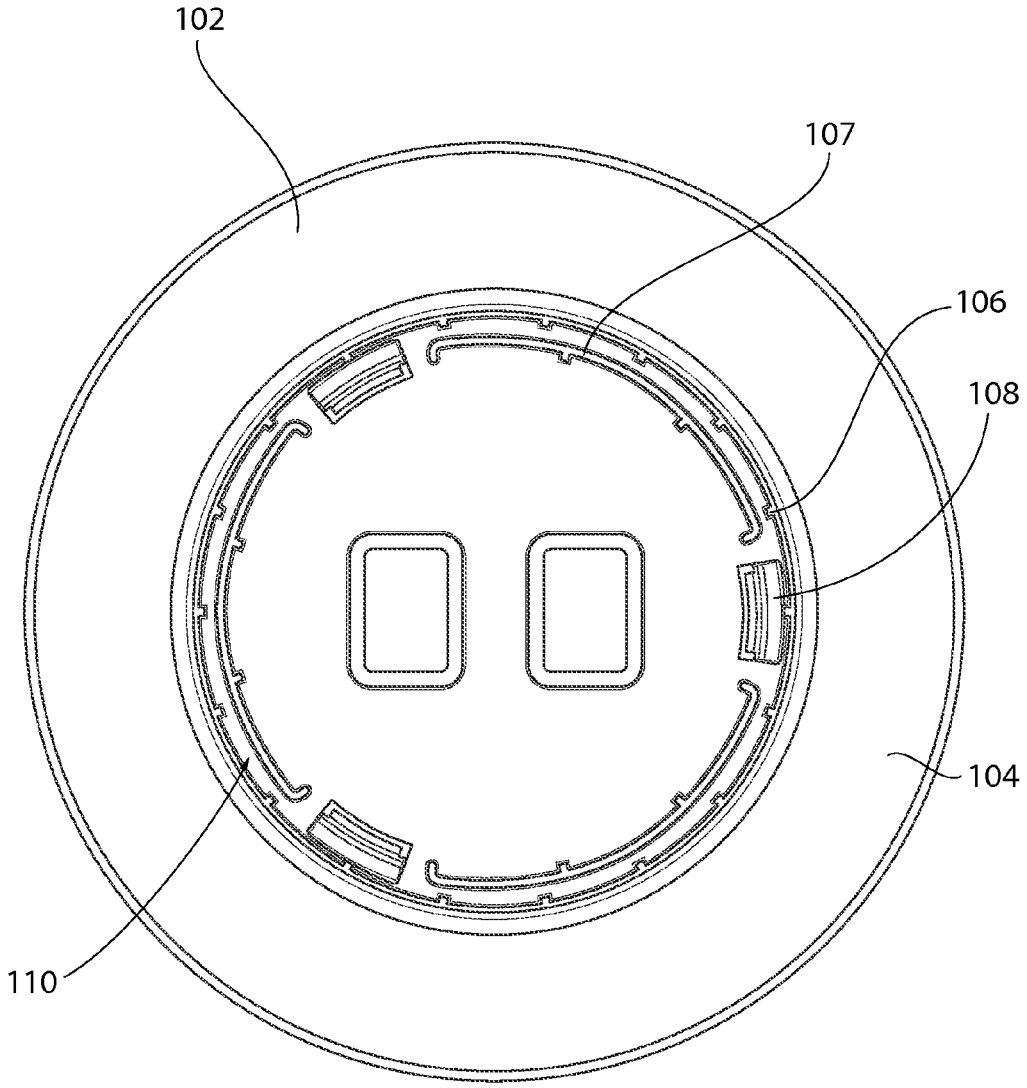
FIG. 10 is a bottom view of the cover of the cover assembly of FIG. 7.
Figure 11:
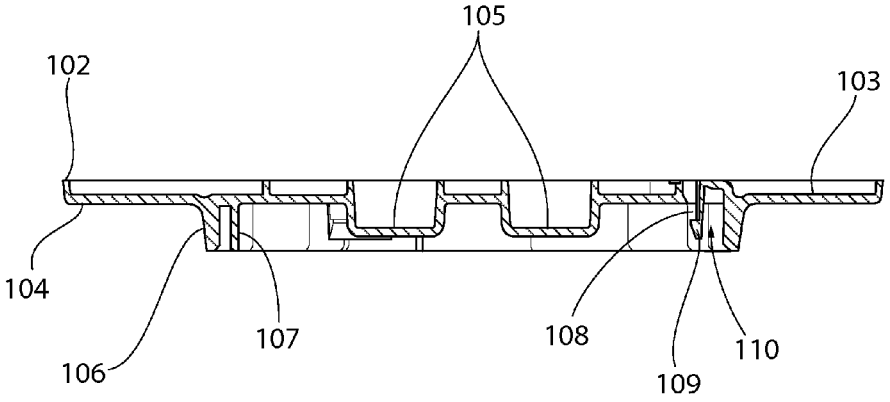
FIG. 11 is a cross-sectional side view of the cover of the cover assembly of FIG. 7 taken along lines 11-11 shown in FIG. 9.
Figure 12:
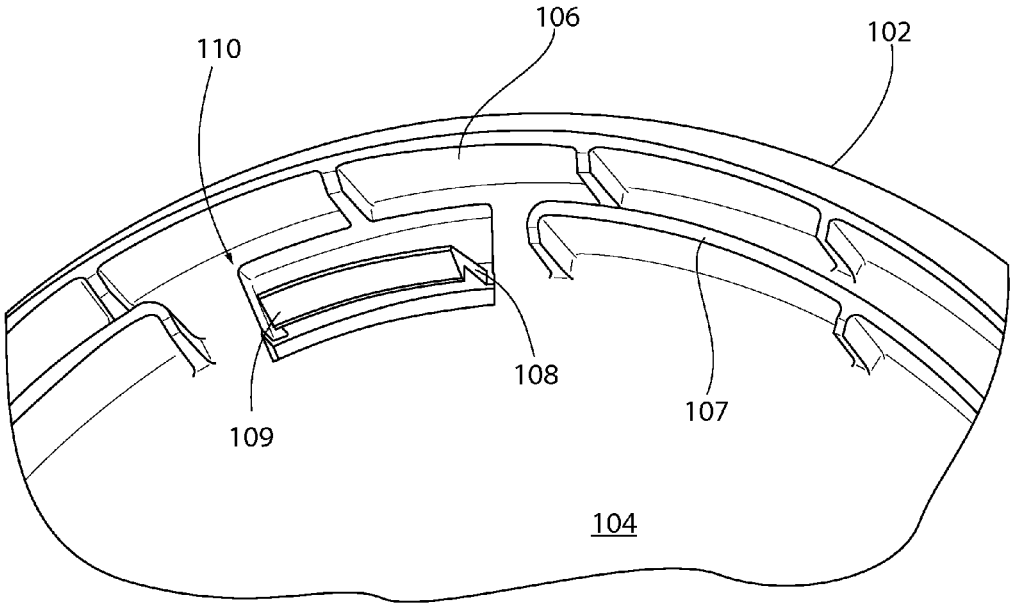
FIG. 12 is an enlarged bottom perspective view of a portion of the cover of the cover assembly of FIG. 7.

With reference to FIG. 8A, an alternative embodiment of the cover assembly 100 is shown. According to this embodiment, a protector sleeve 101*a* is provided with an increased material thickness and a reduced inside diameter as compared to the protector sleeve 101 discussed above with reference to FIGS. 8 and 9-12. As shown, the protector sleeve 101*a* is therefore wrapped tightly around the perimeter of the shank 15 to define the void in the finished concrete surface and to prevent infiltration of concrete to the threads or other connection features present on the shank 15. The engagement of the protector sleeve 101*a* tightly wrapped around the shank 15 serves to maintain the position of the protector sleeve 101*a* on the shank 15 during installation of the drain assembly 10 and pouring of the concrete slab. The protector sleeve 101*a* is not engaged within the channel 110 formed by the projections 106, 107, 108 formed on the bottom 104 of the cover 102. Instead, the protector sleeve 101*a* may be positioned on the shank 15 such that it abuts against the lowermost edges of the arc-shaped projections 107 extending from the bottom 104 of the cover 102 to prevent concrete from infiltrating to the engagement between the snap hooks 109 of the flexible projections 108 and the top ring 20 of the shank 15.

With reference to FIGS. 1-12, according to one embodiment of the invention, a method of installing a drain assembly 10 in a finished floor surface 29 includes providing the drain assembly 10 described above with reference to FIGS. 1-12; adjustably connecting the shank 15 of the drain head assembly 11 to the drain body 16; connecting the drain body 16 to a drain pipe such that the drain body 16 is in fluid communication with the drain pipe; connecting the cover 24, 102 to the shank 15 in the position over the shank 15; adjusting a height of the cover 24, 102 and the shank 15 with respect to the drain body 16 such that the cover 24, 102 is positioned at a level flush with an intended height of the finished floor surface 29; pouring a concrete slab around the cover 24, 102 and over the drain body 16 such the cover 24, 102 at least partially defines a void in the poured concrete slab around the shank 15; removing the cover 24, 102 from the shank 15; and connecting the strainer assembly to the top of the shank 15. The method may further include providing a protector sleeve 101 and positioning the protector sleeve 101 between a bottom 104 of the cover 102 and the drain body 16, and surrounding the shank 15. The method may also further include adjusting the drain head assembly 11 such that a top of the strainer assembly is flush with the finished floor surface 29.

Figure 13:
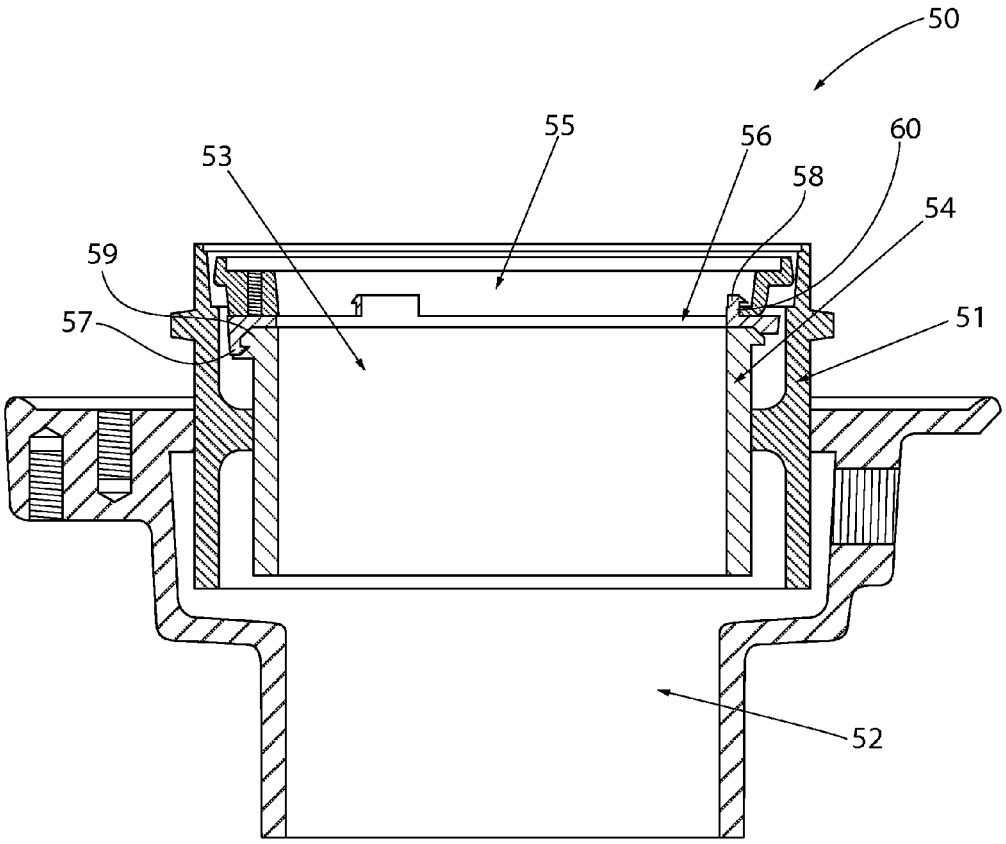
FIG. 13 is a cross-sectional side view of a drain assembly in accordance with another embodiment of the present invention.
Figure 14:
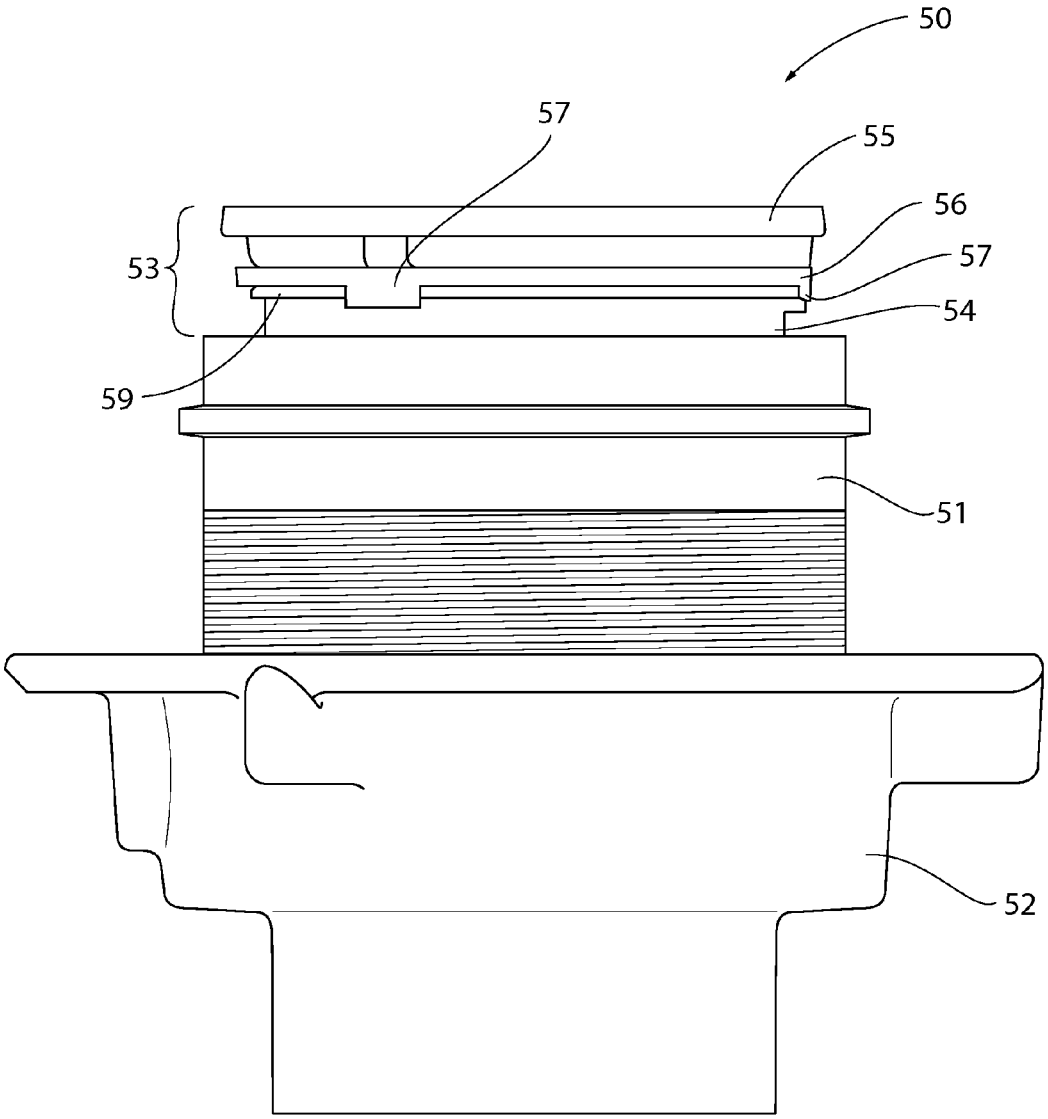
FIG. 14 is a side view of the drain assembly of FIG. 13.
Figure 16A:
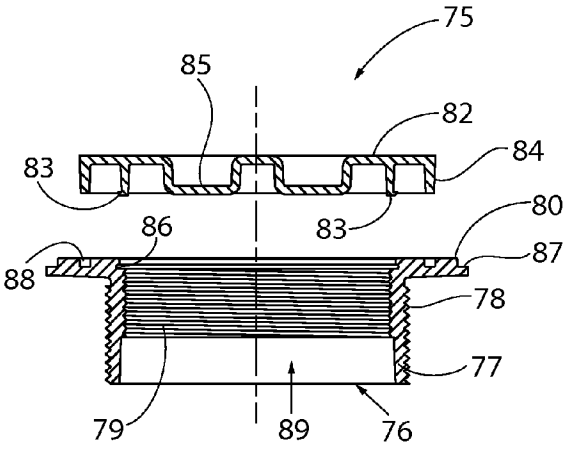
FIGS. 15A, 15B, 16A, and 16B are cross-sectional side views of a rough-in adapter assembly in accordance with yet another embodiment of the present invention.
Figure 16B:
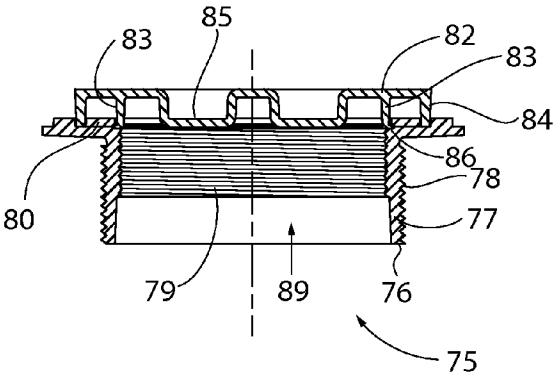
Figure 15A:
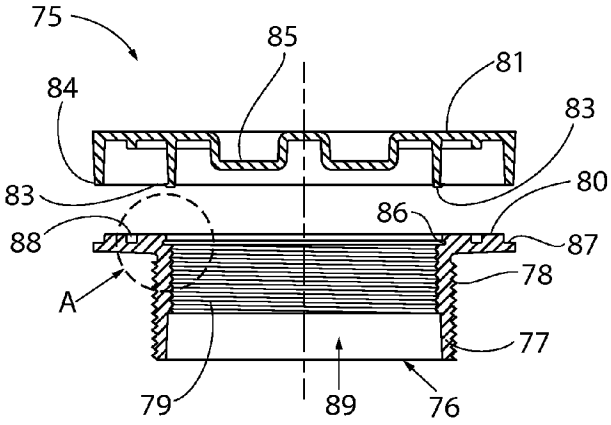
Figure 15B:
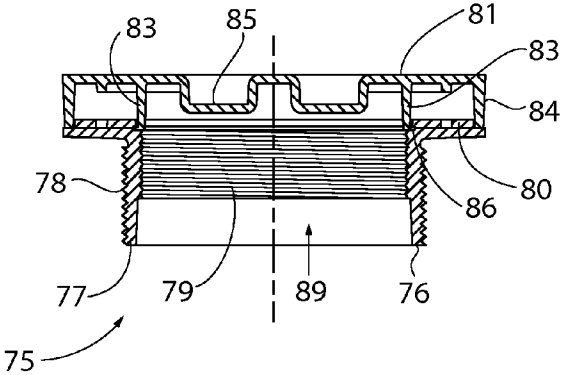
Figure 17:
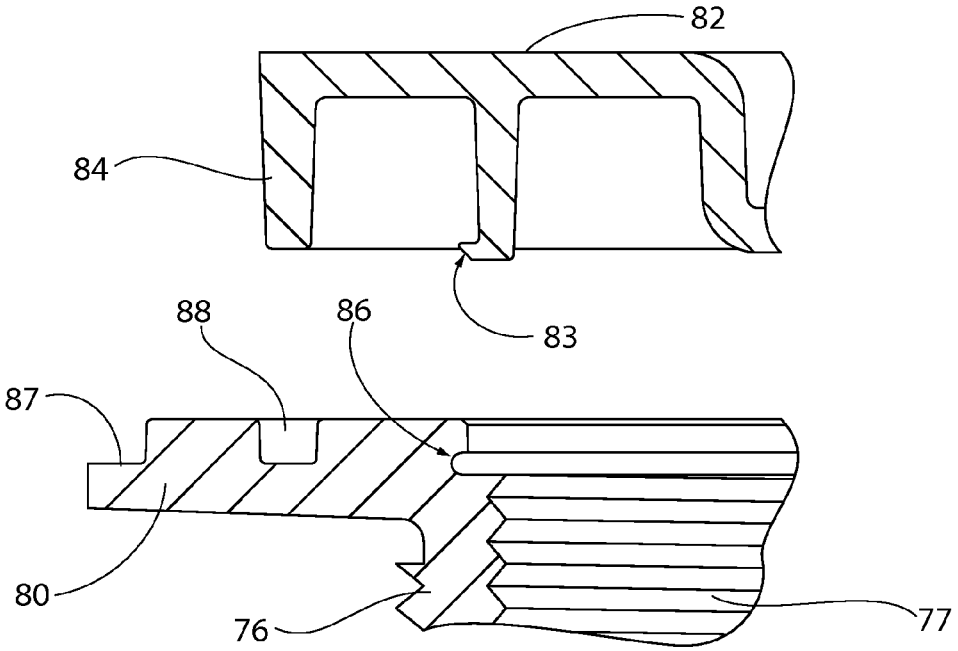
FIG. 17 is a detailed view of the rough-in adapter assembly of FIGS. 15A-16B taken from area "A" in FIG. 15A with the cover removed from the coring sleeve.
Figure 18:
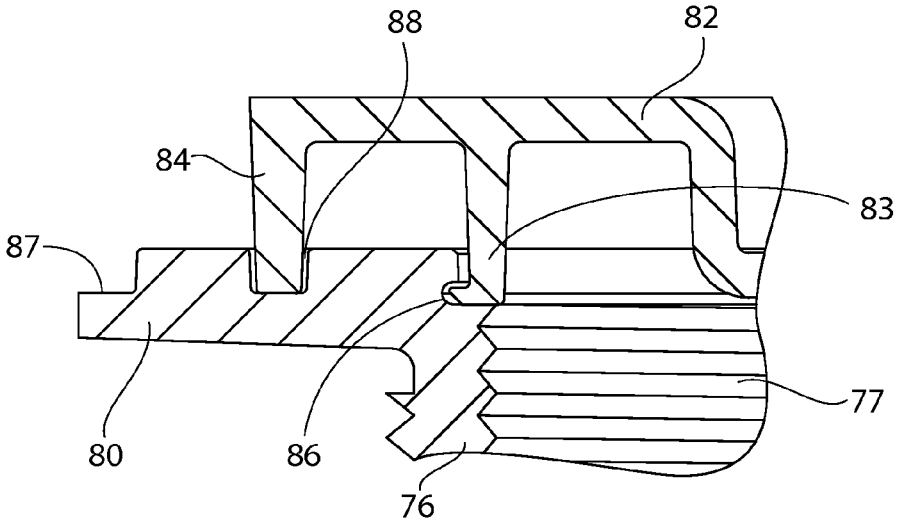
FIG. 18 is a detailed view of the rough-in adapter assembly of FIGS. 15A-16B taken from area "A" in FIG. 15A with the cover positioned on the coring sleeve.

With reference to FIGS. 13 and 14, a drain assembly 50 for installation in a floor surface according to another embodiment of the present invention is shown. The drain assembly 50 includes a rough-in adapter 51 having an exterior surface with male threading that is threadably connected to an interior female threaded surface of a drain body 52, such that the rough-in adapter 51 is adjustably connected to the drain body 52. The rough-in adapter 51 also includes an interior surface with female threading that accepts a drain head assembly 53, such that the drain head assembly 53 is adjustably connected to the rough-in adapter 51.

The drain head assembly 53 includes a threaded shank 54, a frame 55, and a plastic snap ring/lower frame 56. The frame 55 receives a strainer (not shown) that covers the drain opening. The frame 55 includes a bottom flange 60 and the snap ring 56 includes at least two circumferentially-spaced flexible hooks 58 extending from a top surface thereof that engage the bottom flange 60 of the frame 55 by snapping on to the bottom flange 60 to connect the frame 55 to the snap ring 56. Similarly, the threaded shank 54 includes a top flange 59 and the snap ring 56 includes a plurality of circumferentially-spaced hooks 57 extending from a bottom surface thereof that snap on to the top flange 59 to connect the snap ring 56 to the top of the threaded shank 54. Thus, the frame 55 and strainer can be connected to the threaded shank 54 by the snap ring 56 in a manner similar to the connection between the strainer assembly and the threaded shank 15 discussed above with respect to the embodiment shown in FIGS. 1-6.

The rough-in adapter 51 may also be provided with a cover (not shown) that fits within the top of the adapter 51, like a plug, or over the adapter 51 similar to the rough-in cover 24 discussed above with reference to FIG. 6. The cover prevents infiltration of concrete into the rough-in adapter 51 during the pour and defines a void in the finished floor surface to allow for installation and adjustment of the drain head assembly 53. In particular, during installation, the rough-in adapter 51 and drain body 52 are secured to a drain pipe (not shown) installed within the subflooring. The height of the rough-in adapter 51 is then adjusted with respect to the drain body 52 such that the cover is at a position flush with the intended level of the poured concrete slab. The concrete is then poured around the drain body 52 and the rough-in adapter 51 to the intended level such that the rough-in adapter 51 at least partially defines a void in the poured concrete slab suitable for installation of the drain head assembly 53. When the concrete slab is finished, the cover is removed from the rough-in adapter 51 and the drain head assembly 53 is installed such that the strainer is positioned at a level flush with the finished floor surface.

With reference to FIGS. 15A-18, a rough-in adapter assembly 75 for use in the installation of a drain assembly in a finished floor surface in accordance with another embodiment of the present invention is shown. The rough-in adapter assembly 75 includes a coring sleeve 76 having a lower stem 77 and a top flange 80 extending outwardly from the lower stem 77. A central opening 89 extends through the coring sleeve 76 from the top flange 80 to the bottom of the lower stem 77. The lower stem 77 includes male threads 78 on an exterior surface to allow for the coring sleeve 76 to be adjustably connected to a drain body (not shown) or drain pipe (not shown), and female threads 79 on an interior surface to allow for a drain head assembly (not shown) to be adjustably connected to the coring sleeve 76 within the central opening 89 to place the drain head assembly in communication with the drain body and/or drain pipe.

The rough-in adapter assembly 75 also includes a cover 81, 82. According to the embodiment shown in FIGS. 15A-18, the top flange 80 of the coring sleeve 76 is configured to engage a 6" cover 81 (FIGS. 15A & 15B) or a 5" cover 82 (FIGS. 16A & 16B), depending on the size of the drain assembly to be used with the coring sleeve 76. The cover 81, 82 includes a plurality of non-continuous circumferentially-spaced legs 83 extending downward from an inside surface of the top of the cover 81, 82. According to a particular embodiment, the cover 81, 82 includes six equally spaced legs 83. The legs 83 each include a projection formed at an end thereof in the form of a hook or tooth that is configured to snap into a groove 86 formed in the top flange 80 of the coring sleeve 76 at the mouth of the central opening 89 to releasably secure the cover 81, 82 to the coring sleeve 76. An outside rim 84 of the cover 81, 82 fits within a complementary annular recess 87, 88 formed in the top flange 80 of the coring sleeve 76 when the cover 81, 82 is secured to the coring sleeve 76.

During installation, the rough-in adapter assembly 75 is threadably secured to the drain body and/or the drain pipe installed within the subflooring. The height of the rough-in adapter assembly 75 is then adjusted such that the top surface of the cover 81, 82 is at a position flush with the intended level of the poured concrete slab. The concrete is then poured around the rough-in adapter assembly 75 to the intended level, with the top flange 80 and the cover 81, 82 in combination defining a void in the concrete slab to allow for installation and adjustment of a drain head assembly. When the concrete slab is finished, the cover 81, 82 is removed from the coring sleeve 76 and the drain head assembly is installed, such that the strainer is positioned at a level flush with the finished floor surface. The top surface of the cover 81, 82 may include a notch or recess 85 to facilitate removal of the cover 81, 82 from the finished concrete slab.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention, which is to be given the full breadth of the appended claims and any and all equivalents thereof.

The invention claimed is:

1. A drain assembly, comprising:

a drain body configured to be connected to a drain pipe such that the drain body is in fluid communication with the drain pipe; and a drain head assembly adjustably connected to the drain body such that the drain head assembly is in fluid communication with the drain body, the drain head assembly comprising:

a shank adjustably connected to the drain body; and a strainer assembly connected to a top of the shank, the strainer assembly including a strainer, an upper frame, and a lower frame connected to each other, wherein the lower frame includes a connection feature configured to non-threadably and removably connect the strainer assembly to the top of the shank and the shank of the drain head assembly is located in the drain body;

wherein the connection feature of the lower frame includes at least two flexible hooks extending from a bottom of the lower frame and configured to engage the top of the shank; and wherein the lower frame includes at least two flexible hooks extending from a top of the lower frame and the upper frame includes a bottom flange, the lower frame being connected to the upper frame by an engagement between the flexible hooks extending from the top of the lower frame and the bottom flange of the upper frame.

2. The drain assembly according to claim 1, wherein the shank includes external threads and is threadably connected to the drain body.

3. The drain assembly according to claim 1, wherein the at least two flexible hooks extending from the bottom of the lower frame comprise six flexible hooks equally circumferentially-spaced around the lower frame.

4. The drain assembly according to claim 1, wherein the shank includes a top ring at the top of the shank, the top ring of the shank being configured to be engaged by the flexible hooks extending from the bottom on the lower frame.

5. The drain assembly according to claim 4, wherein the top of the shank includes at least two sets of lugs extending outward from the top ring, each of the at least two sets of lugs being configured to engage a respective one of the at least two flexible hooks extending from the bottom on the lower frame to prevent rotation of the strainer assembly with respect to the shank.

6. The drain assembly according to claim 1, wherein the strainer, upper frame, and lower frame are connected by fasteners engaging the strainer, upper frame, and the lower frame.

7. The drain assembly according to claim 1, further comprising a rough-in adapter adjustably connected to the drain body, wherein the shank of the drain head assembly is adjustably connected to the rough-in adapter, and wherein the rough-in adapter is configured to at least partially define a void in a poured concrete slab.

8. The drain assembly according to claim 7, further comprising a removable cover positioned on the rough-in adapter and the removable cover and the rough-in adapter in combination are configured to define the void in the poured concrete slab.

9. The drain assembly according to claim 8, wherein the cover includes internal hooks for removably connecting the cover to the shank.

10. The drain assembly according to claim 1, further comprising:

a cover configured to be positioned on the drain body over the shank to at least partially define a void in a poured concrete slab around the shank, the cover being configured to be removably connected to the shank.

11. A drain assembly, comprising:

a drain body configured to be connected to a drain pipe such that the drain body is in fluid communication with the drain pipe;

a drain head assembly adjustably connected to the drain body such that the drain head assembly is in fluid communication with the drain body, the drain head assembly including a shank adjustably connected to the drain body in which the shank is located;

a cover configured to be removably connected to the shank in a position over the shank and to at least partially define a void in a poured concrete slab around the shank; and a protector sleeve configured to be positioned between a bottom of the cover and the drain body and surrounding the shank;

wherein the cover includes at least one projection on the bottom of the cover;

wherein the cover and the protector sleeve in combination are configured to define the void in the poured concrete slab, and the at least one projection on the bottom of the cover is configured to engage the shank to removably connect the cover to the shank;

wherein the at least one projection on the bottom of the cover includes an outer annular projection forming an outer ring within a perimeter of the cover, a plurality of inner arc-shaped projections concentric with the outer annular projection, and at least two inner flexible projections circumferentially aligned with the inner arc-shaped projections configured to engage the shank to removably connect the cover with the shank;

wherein the inner arc-shaped projections and the at least two inner flexible projections form an inner ring within a diameter of the outer ring formed by the outer annular projection to define a channel between the inner and outer rings; and wherein the inner and outer rings are configured to engage and retain the protector sleeve within the channel.

12. The drain assembly according to claim 11, wherein the cover is configured to be positioned on the drain body over the shank and includes internal hooks for removably connecting the cover to the shank.

13. The drain assembly according to claim 11, wherein the at least two inner flexible projections include snap hooks configured to engage a top ring of the shank.

14. The drain assembly according to claim 11, wherein the drain head assembly further includes a strainer assembly removably connected to a top of the shank, the strainer assembly including a strainer, an upper frame, and a lower frame connected to each other, and wherein the lower frame includes a connection feature configured to non-threadably and removably connect the strainer assembly to the top of the shank.

15. The drain assembly of claim 11, wherein the cover is impenetrable by concrete and lacks openings.

* * * * *